US005759113A

United States Patent [19]

Lai et al.

[11] Patent Number: 5,759,113

[45] Date of Patent: Jun. 2, 1998

[54] VIBRATION DAMPED GOLF CLUBS AND BALL BATS

[75] Inventors: Ming-Lai Lai; Edmond J. Nielsen, both of Lake Elmo, Minn.

[73] Assignee: Minnesota Mining and Manufacturing Company, St. Paul, Minn.

[21] Appl. No.: 670,792

[22] Filed: Jun. 21, 1996

[51] Int. Cl.[6] ..... A63B 00/00

[52] U.S. Cl. ..... 473/321; 473/520

[58] Field of Search ..... 473/318, 319–322, 473/520

[56] References Cited

U.S. PATENT DOCUMENTS

| | | | |
|---|---|---|---|
| 1,906,239 | 5/1933 | Reach . | |
| 3,941,380 | 3/1976 | Lacoste . | |
| 5,214,180 | 5/1993 | Ferrari et al. . | |
| 5,219,164 | 6/1993 | Peng . | |
| 5,277,423 | 1/1994 | Artus . | |
| 5,294,119 | 3/1994 | Vincent et al. . | |
| 5,297,791 | 3/1994 | Negishi . | |
| 5,374,057 | 12/1994 | Lai et al. | 273/73 |
| 5,421,574 | 6/1995 | Yamagishi et al. . | |
| 5,507,477 | 4/1996 | Manning | 267/140.3 |
| 5,545,094 | 8/1996 | Hsu | 473/317 |
| 5,599,242 | 2/1997 | Solviche et al. | 473/318 |

OTHER PUBLICATIONS

C. D. Johnson & D. A. Kienholz, "Finite Element Prediction of Damping in Structures with Constrained Viscoelastic Layers," *AIAA Journal*, vol. 20, No. 9, Sep. 1982, pp. 1284–1290.

3M Vibration Control, *3M Engineered Foam Products*, 70–0705–7553–3 TD DP–460.PRF 223, 3M 1994.

3M Vibration Control, *3M Noise and Vibration Control Systems*, 70–0706–5920–9 3M 1995.

3M Vibration Control Systems, *EF–300 Acoustical Absorbing/Damping foam: Revised Preliminary Data Specifications: Nov. 22, 1995.*

3M Product Information and Performance Data, Scotchdamp™ Vibration Control Systems, Brochure No. 70–0703–7536–8(73.4)R1 Dated 1993.

"Elements of Vibration Analysis", 2nd Edition, by L. Meirovitch, McGraw–Hill, pp. 54 and 97, dated 1986.

"Viscoelastic Properties of Polymers" by John D. Ferry, John Wiley & Sons Chapter 1, pp. 9–14, dated 1980.

*Primary Examiner*—Mark S. Graham

*Attorney, Agent, or Firm*—Janice L. Dowdall

[57] ABSTRACT

The present invention provides novel damped golf clubs and balls bats having at least one non-tubular constrained layer damper attached to the golf club shaft or bat, respectively.

20 Claims, 10 Drawing Sheets

VIBRATION DAMPED GOLF CLUBS AND BALL BATS

FIELD OF THE INVENTION

The present invention provides novel golf clubs and ball bats that are damped to minimize adverse effects from vibration upon use.

BACKGROUND OF THE INVENTION

Sports equipment undergoes vibration when it comes into contact with the ball it is intended to be used with. These vibrations are problematic in that they can potentially distract the player's attention and adversely affect performance; cause injury to the player's hands, arms, and body; and cause noise. In the past various attempts have been made to overcome these problematic vibrations.

In the golf club area attempts have been made to overcome the problems of vibrations.

Reach, U.S. Pat. No. 1,906,239, teaches a golf club wherein a tubular sleeve of distortable resilient material, such as vulcanized rubber, is interposed between a metal hosel and a metal shaft. By doing so, Reach aims to first avoid making the golf club too rigid so as to permit the desired torsional cushioning effect of a wood shaft club.

Artus, U.S. Pat. No. 5,277,423 discloses damped instruments including a golf club having a vibration damping means fixed on the shaft at a position about one third the length of the shaft from the striking head. The vibration damping means comprises a tubular viscoelastic layer, having a thickness of 0.2 to 3.0 mm, fixed to the surface of the shaft and a rigid tubular sleeve fixed to the viscoelastic layer to thereby constrain the viscoelastic layer. The patent further states that the damping assembly of the invention is positioned on the shaft at a location corresponding to a vibration antinode determined before-hand by any known means. On a golf club shaft this antinode is located in the vicinity of the first third of the shaft starting from the head. An example discloses a damping assembly 40 mm in length.

Vincent et al., U.S. Pat. No. 5,294,119 teaches a golf club shaft formed by a unitary tubular structure having a total length L and having at least one particular vibration damping device positioned in at least one upper and lower intermediate sections of the shaft. The damping device has at least one rigid layer joined to a surface of the shaft by means of an intermediate layer of viscoelastic material in the shape of a ring which may be positioned internally or externally to the shaft. The rigid material may be in the form of a ring. Optionally, the outer ring can be composed of several adjacent portions separated by longitudinally extending grooves. The lower part and the lower intermediate section have a combined length of approximately 0.2 L. The upper intermediate section has a length of approximately 0.2 L and is positioned at a distance from the upper end of approximately 0.2 L. It is described as a device for selectively damping golf club vibrations by controlling their frequencies through optimal positioning at the point of maximum deformation energy from the vibration modes excited after impact.

Negishi, U.S. Pat. No. 5,297,791 discloses a vibration preventing piece made of metal alloy firmly mounted on a golf club shaft at the position defined by an inequality of $1.8 \geqq c/d \geqq 0.35$ wherein "c" designates a distance between the tip side of the golf club shaft and a center of the vibration preventing piece and "d" designates a distance between the butt side of the golf club shaft and the center of the vibration preventing piece.

Attempts to damp golf clubs have not been completely satisfactory as the amount and type of damping desired has not been attained. A need thus exists for a golf club that has improved damping performance.

In the ball bat area the following attempts have been made to overcome the problems of vibrations.

Peng, U.S. Pat. No. 5,219,164 describes a shock absorbing bat having an elastic end piece and elastic guard piece made from liquid casting compound molded directly with the bat at the front and rear ends, respectively.

Lacoste, U.S. Pat. No. 3,941,380 discloses an elongated vibratable member formed of elastomeric energy absorbing material attached by one end to a point near an antinode on a baseball bat and the like. The vibratable member is adjusted to vibrate at a similar frequency to that induced in, e.g., a baseball bat as a result of striking a game ball. The vibratable member acts like a tuned mass damper.

Yamagishi et al. U.S. Pat. Nos. 5,421,574 and 5,214,180 disclose sports instruments having a vibration-reducing material embedded as part of the material of the sports instruments without changing the conventional outer appearance of the instruments. The vibration-reducing material is thermally cured and has a vibration loss coefficient of not less than 0.01 at room temperature. These patents also disclose an impact-absorbing element to be attached to an exterior surface of conventional sports instrument. The impact-absorbing element follows the impact to the sports instrument and vibration transmitted from the vibration source and induces microvibration on micromovement generating a small time lag from the transmitted impact and vibration so as to neutralize the original vibration. The impact absorbing element acts like a tuned mass damper.

Attempts to damp balls bats have not been completely satisfactory as the amount and type of damping desired has not been attained. A need thus exists for ball bats that have improved damping performance.

SUMMARY OF THE INVENTION

We have discovered novel golf clubs that have good damping performance. The present invention provides a novel damped golf club comprising:

(a) a striking head having a front surface and a back surface, the front surface being the striking surface, the striking head also having a hosel;

(b) a shaft having a first end and a second end, wherein the first end of the shaft is in connection with the hosel of the striking head;

(c) a grip into which the second end of the shaft is inserted;

(d) at least one constrained layer damper attached to the shaft, wherein each constrained layer damper is non-tubular and each constrained layer damper independently comprises:

(i) a non-tubular outer rigid layer, a non-tubular outer vibration damping material layer comprising a viscoelastic material attached to one side of the outer rigid layer;

(iii) optionally one or more inner rigid layers, positioned between the outer rigid layer and the outer vibration damping material layer;

(iv) optionally one or more inner vibration damping material layers positioned between the outer rigid layer and the outer vibration damping material layers;

(iii) optionally an adhesive layer between any of the vibration damping material layer(s) and the rigid layer(s);

wherein each rigid layer in the constrained layer damper is separated from another rigid layer by at least one of the following selected from the group consisting of (A) and (B):

(A) a layer of vibration damping material;

(B) a layer of adhesive;

wherein the outer rigid layer and the inner rigid layer(s) if present have shear moduli at least about 10 times greater than that of the vibration damping material layer(s); and wherein the constrained layer damper(s) are attached to the shaft in such a manner that the outer vibration damping material layer is adjacent to the shaft, wherein one of the following is true: (1) the constrained layer damper(s) are attached to an external surface of the shaft, (2) the constrained layer damper(s) are attached to an internal surface of the shaft, (3) one or more constrained layer damper(s) are attached to an internal surface of the shaft and one or more constrained layer dampers are attached to an external surface of the shaft;

wherein at least one damper must be positioned on the shaft such that it at least partially falls within one or both of the following degree ranges: (i) the 1 to 179 degree range; (ii) the 181 to 359 degree range;

wherein the degree ranges are calculated such that when the club is positioned striking surface down on a flat surface the 90 degree point is the uppermost point on the shaft when viewed in cross section from the direction of the striking head toward the gripping end and the 270 degree point is the lowermost point on the shaft when the shaft is likewise viewed in cross section.

The novel golf clubs of the invention have a number of advantages. The novel golf clubs in which the vibration damping material layer is non-tubular (i.e., not in the form of a ring), provides for a more efficient use of the damping material since the damping material can be placed in a position which provides for optimum damping, thus saving on the amount of damping material used and limiting the amount of weight added to the club. This is partially due to the discovery of the optimum position for placing a damper (s) on the circumference of the shaft. In addition, the optimum position of the damper(s) along the length of the shaft is discussed herein. Thus, due to this invention one is able to provide potentially the same or better damping performance from one or more individual non-tubular dampers than a tubular damper of the same length. Also depending on the positioning one can potentially achieve better damping performance from fewer dampers of a particular length, width, and thickness compared to a greater number of identical dampers, merely due to the positioning of the dampers.

We have also discovered a novel ball bat that has good damping performance.

The present invention thus provides a novel article comprising:

(a) a bat having a first end and a second end attached together, wherein the first end is a hitting end and the second end is a handle;

(b) at least one constrained layer damper attached to the bat, wherein each constrained layer damper is non-tubular and each constrained layer damper independently comprises:

(i) a non-tubular outer rigid layer, (ii) a non-tubular outer vibration damping material layer comprising a viscoelastic material attached to one side of the outer rigid layer;

(iii) optionally one or more inner rigid layers, positioned between the outer rigid layer and the outer vibration damping material layer;

(iv) optionally one or more inner vibration damping material layers positioned between the outer rigid layer and the outer vibration damping material layers;

(iii) optionally an adhesive layer between any of the vibration damping material layer(s) and the rigid layer(s);

wherein each rigid layer in the constrained layer damper is separated from another rigid layer by at least one of the following selected from the group consisting of (A) and (B):

(A) a layer of vibration damping material;

(B) a layer of adhesive;

wherein the outer rigid layer and the inner rigid layer(s) if present have shear moduli at least about 10 times greater than that of the vibration damping material layer(s); and wherein the constrained layer damper(s) are attached to the bat in such a manner that the outer vibration damping material layer is adjacent to the bat, wherein one of the following is true: (1) the constrained layer damper(s) are attached to an external surface of the bat, (2) the constrained layer damper(s) are attached to an internal surface of the bat, (3) one or more constrained layer damper(s) are attached to an internal surface of the bat and one or more constrained layer dampers are attached to an external surface of the bat.

The novel bats of the invention have a number of advantages. The novel bats in which the vibration damping material layer is non-tubular (i.e., not in the form of a ring), provides for a more efficient use of the damping material since the damping material can be placed in a position which provides for optimum damping, thus saving on the amount of damping material used and limiting the amount of weight added to the bat. This is partially due to the discovery of the optimum position for placing a damper(s) on the circumference of the bat. In addition, the optimum position of the damper(s) along the length of the bat is discussed herein. Thus, due to this invention one is able to provide potentially the same or better damping performance from one or more individual non-tubular dampers than a tubular damper of the same length. Also depending on the positioning one can potentially achieve better damping performance from fewer dampers of a particular length, width, and thickness compared to a greater number of identical dampers, merely due to the positioning of the dampers.

DETAILED DESCRIPTION OF THE INVENTION

Constrained Layer Dampers

Figure 1A:
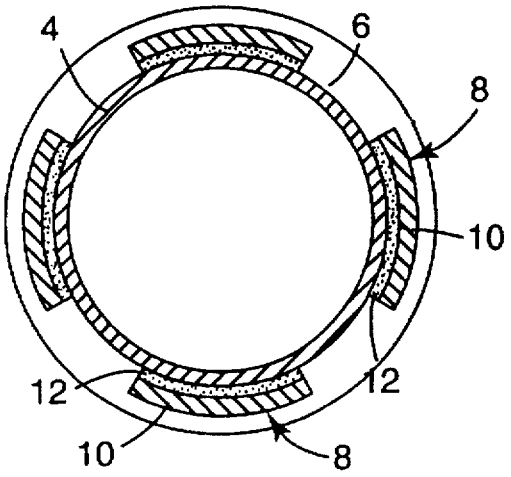
FIG. 1*a* illustrates a cross-section of the novel golf club of FIG. 1 taken along line 1*a*—1*a*.

As indicated previously the novel articles of the invention each have at least one non-tubular constrained layer damper having at least one vibration damping material layer and at least one rigid layer attached thereto.

Vibration Damping Materials

A variety of vibration damping materials can be used in the constrained layer dampers used in the articles of the invention.

A vibration damping material layer may be continuous or discontinuous. A continuous vibration damping material layer may comprise one type of damping material or may comprise adjacent sections of different vibration damping materials, for example (i.e., of different chemical compositions, for example). A discontinuous layer may comprise sections of damping material separated by non-damping material(s) or space(s) for example. In addition when at least two damping layers are present each layer may comprise the same or different damping material(s). Preferably, the rigid layer(s) are substantially covered with a continuous layer(s) of damping material, although the layer(s) may be discontinuous.

The vibration damping material comprises a viscoelastic material. A viscoelastic material is one that is viscous, and therefore capable of dissipating energy, yet exhibits certain elastic properties, and therefore capable of storing energy at the desired temperature and frequency range. That is, a viscoelastic material is a material typically containing long-chain molecules that can convert mechanical energy into heat when they are deformed. Such a material typically can be deformed, e.g., stretched, by an applied load and gradually regain its original shape, e.g., contract, sometime after the load has been removed.

For a viscoelastic material, two shear moduli (storage modulus G' and loss modulus G") are used to characterize the material, see "Viscoelastic Properties of Polymers.", Chapter 1, pp. 9–14, John Wiley Ferryand Sons, Inc. (1980). Suitable viscoelastic materials for use in the vibration damping materials of the present invention have a shear storage modulus G', i.e., measure of the energy stored during deformation, of at least about 1 psi ($6.9\times10^3$ Pascals) at the operating temperature and frequency (typically about −10° C. to 40° C. and about 1 Hz to 2,000 Hz). The storage modulus of useful viscoelastic materials can be as high as 10,000 psi ($6.9\times10^7$ Pascals); however, typically it is about 5–5000 psi ($3.5\times10^4$–$3.5\times10^7$ Pascals).

Suitable viscoelastic materials, at the operating temperature and frequency, for use in the vibration damping materials of the present invention have a loss factor $\eta$, i.e., the ratio of energy loss to energy storage or the ratio of the shear loss modulus G" to shear storage modulus G', of at least about 0.1. Preferably the loss factor is at least about 0.2, more preferably greater than about 0.4, and most preferably above 0.6, at the operating frequency and temperature experienced by the material. For example, 3M™ ISD 112, an acrylic viscoelastic polymer, at a frequency of 50 Hz and a temperature of 20° C. has a loss factor of about 0.9, while at 40° C., it has a loss factor of about 0.8.

Useful vibration damping materials can be isotropic as well as anisotropic materials, particularly with respect to their elastic properties. As used herein, an "anisotropic material" or "nonisotropic material" is one in which the properties are dependent upon the direction of measurement. Suitable materials having viscoelastic properties include urethane rubbers, silicone rubbers, nitrile rubbers, butyl rubbers, acrylic rubbers, natural rubbers, styrene-butadiene rubbers, and the like. Other useful damping materials include polyesters, polyurethanes, polyamides, ethylene-vinyl acetate copolymers, polyvinyl butyral, polyvinyl butyral-polyvinyl acetate copolymers, epoxy-acrylate interpenetrating networks and the like. Thermoplastics and thermosetting resins suitable for use as vibration damping material may also be utilized.

Useful vibration damping materials can also be crosslinkable to enhance their strength and processability. Such materials are classified as thermosetting resins. When the viscoelastic material is a thermosetting resin, then prior to the manufacture of the damper, the thermosetting resin is typically in a thermoplastic state. During the manufacturing process, the thermosetting resin can be further cured and/or crosslinked typically to a solid state, although it could be a gel upon curing as long as the cured material possesses the viscoelastic properties described above. Depending upon the particular thermosetting resin employed, the thermosetting resin can include a curing agent, e.g., catalyst, which when exposed to an appropriate energy source (such as thermal energy) initiates the polymerization of the thermosetting resin. Particularly preferred vibration damping materials are those based on acrylates.

In general, any suitable viscoelastic material can be used. The choice of viscoelastic material for a particular set of conditions, e.g., temperature and frequency of vibration, etc., is within the knowledge of one of skill in the art of vibration damping. The selection of a suitable damping material is also based on the processability of the damping material into a constrained layer damper (cutting or other fabricating) and the desired integrity of the finished damper construction with the damping material selected. It is to be understood that blends of any of the foregoing materials can also be used.

In addition to the viscoelastic material, the vibration damping material of the present invention may, it is theorized, include an effective amount of a fibrous and/or particulate material. Herein, an "effective amount" of a fibrous material and/or particulate is an amount sufficient to impart at least improvement in desirable characteristics to the viscoelastic material.

The fibrous and/or particulate material would be, it is theorized, used in an amount effective to enhance the strength of the vibration damping material of a constrained layer damper containing the same amount and type of viscoelastic material without the fibrous or particulate material. Typically, it is theorized, the amount of the fibrous material included in the viscoelastic material, if used, would be within a range of about 3–60 wt % based on the total weight of the vibration damping material. Typically, it is theorized, the amount of the particulate material included in the viscoelastic material, if used, would be within a range of about 0.5–70 wt % based on the total weight of the vibration damping material.

The fibrous material can be in the form of fibrous strands or in the form of a fiber mat or web, although fibrous strands are preferred. The fibrous strands can be in the form of threads, cords, yarns, rovings, filaments, etc., as long as the viscoelastic can wet the surface of the material. They can be dispersed randomly or uniformly in a specified order. Examples of useful fibrous materials, it is theorized, include metallic fibrous materials, such as aluminum oxide, magnesium, or steel fibers, nonmetallic fibrous materials, such as fiberglass, natural organic fibrous materials such as wool, silk, cotton, and cellulose and synthetic organic fibrous materials such as polyvinyl alcohol, nylon, polyester, rayon, polyamide, acrylic, polyolefin, aramid, and phenol.

The particulate material useful in the invention can be, it is theorized, in the form of nodules, bubbles, beads, flakes, or powder, as long as the viscoelastic material can wet the surface of the particulate. The particulate material can vary in size, but should not typically be greater than the thickness of the damping material layer.

Examples of useful particulate materials, it is theorized, include coated or uncoated glass and ceramic bubbles or beads such as thermally conductive bubbles, powders such as aluminum oxide powder and aluminum nitride powder, silica, metal flakes such as copper flakes, cured epoxy nodules, and the like.

Combinations of fibrous material and particulate material would, it is theorized, also be useful and would most likely be used in the range of about 0.5 to about 70 weight percent based on the total weight of the vibration damping material.

In addition to fibers and particulate material, the vibration damping material of the present invention can include additives such as fillers (e.g. talc, etc.), colorants, toughening agents, fire retardants, antioxidants, antistatic agents, and the like. Sufficient amounts of each of these materials can be used to produce the desired result.

The preferred viscoelastic materials are 3M™ acrylic viscoelastic polymer, types 110, 112 and 113 available from 3M, St. Paul, Minn., and described in Suggested Purchase Specification, 3M™ Viscoelastic Polymers, No. 70-072-0225-7(89.3)R1 from 3M Industrial Tape and Specialties Division.

Rigid Layers

A variety of rigid layers can be used in the constrained layer dampers used in the articles of the invention.

The rigid layer may be formed from a material including but not limited to those selected from the group consisting of metals, such as steel, stainless steel, copper, aluminum, etc.; metal alloys; plastics; graphite composite materials; and woods. Typically the rigid layer is formed from a graphite composite material or metallic material such as aluminum or from wood. Typically, the rigid layers are in the form of strips, most typically strips that are rectangular or tapered rectangular in shape which can optionally be curved to better fit on the club shaft or bat.

The rigid layers can be continuous or discontinuous lengthwise and typically have a shear modulus greater than that of the vibration damping layer which also makes up the constrained layer damper. The rigid layer typically has a shear modulus at least about 10 times greater than the storage shear modulus of the vibration damping material layer(s), preferably at least about 100 greater, more preferably at least about 1000 times greater, and most preferably about 10,000 times greater.

For the rigid layer, the ratio of a shear stress to the corresponding shear strain is called the shear modulus and is represented below by G.

$$G = \frac{\text{shear stress}}{\text{shear strain}}$$

For most materials it is one-third to one-half as great as Young's modulus.

The thickness of the rigid layers can vary depending upon the desired application of the constrained layer damper. If a rigid layer is too thin, it may not have stiffness enough to ensure large strain in the damping material. If a rigid layer is too thick, the damper becomes heavier than necessary which can have an adverse effect on the player.

The length and width of the rigid layers can vary. Each constrained layer damper typically has the rigid layer and the vibration damping material layer of the same length and width. However, it is possible that a layer of vibration damping material of certain dimension on the shaft may have several rigid layers of much smaller dimensions positioned thereon such that the damping material has areas which are not covered by the rigid layers. In such a situation the dimensions of length and width of the damper would be the length and width of the damping material section itself. Preferably, the amount the surface of any one vibration damping material layer covered by rigid layer(s) is 80 to 100 percent.

Adhesive Layer

In order to facilitate the adhesion of the vibration damping material layer to the rigid layers and the shaft of the golf club or the bat, a layer of adhesive such as an epoxy can optionally be provided between the rigid layer and the vibration damping material layer and the vibration damping material layer and the shaft or bat to more effectively bond the layers together. The adhesive used should form a bond between the rigid layer and the damping material layer having greater strength than the strength of the vibration damping material layer itself.

The adhesive layer is preferably moisture resistant and resistant to any solvents, gases, or chemicals it may come into contact with in its operating environment. In addition, the adhesive layer is preferably resistant to plasticizers or residual solvents which may be contained in the vibration damping material layer. Preferably, the adhesive layer is more resistant than the vibration damping material layer to shear strength decreases with increases in temperature. A preferred adhesive will have a shear strength which exceeds the shear strength of the damping material at all operating temperatures, typically about 0° C. to about 40° C., most typically about 15° C. to about 35° C.

Examples of suitable adhesives include but are not limited to those selected from the group consisting of epoxy structural adhesives such as Scotch-Weld™ brand DP-460 epoxy adhesive available from 3M Company, urethanes, polyesters, acrylics, cyanoacrylates, rubber/resin, and the like.

Golf Clubs

As indicated previously the novel golf clubs of the invention have at least one non-tubular constrained layer damper attached thereto. The damper(s) are attached to the shaft of the golf club. Typically the shaft is inserted into the neck or hosel of the striking head at one end and into a grip at the other end. The constrained layer dampers may be attached to an internal and/or external surfaces of the golf club shaft. Although internal application may be preferable for aesthetic reasons, external application of the damper is preferred in order to obtain the best damping performance. The dampers may be internally applied since a golf club shaft is typically hollow. When the constrained layer damper (s) are externally applied they may optionally be applied in indentation(s) in the golf club shaft in order to provide a more aesthetically pleasing appearance (i.e. a smooth golf club surface) although it is by no means necessary that they be applied in indentations. The internally applied dampers may also optionally be applied in indentations in the golf club shaft.

The size (width, length, and thickness) of each constrained layer damper can vary depending upon the particular application. Preferably all the layers making up the damper have the same dimensions of length and width. The shape of the damper can vary although it is typically of a symmetrical geometric shape. Examples of suitable shapes include but are not limited to those selected from the group consisting of rectangles, triangles, diamonds, circles, ovals, etc. The damper shape may optionally be tapered in order to better fit on the golf club shaft since such shafts are typically tapered. The length of the damper is typically (but not always) much greater than its width or thickness. Alternatively, similar damping performance may be attained by using several short dampers in place of a long damper.

Typically the length of each damper ranges from about 10 to about 100 percent of the length of the shaft, preferably about 20 to about 80 percent of the length of the shaft, and most preferably about 30 to about 60 percent of the length of the shaft.

The width of the damper can also vary. The width depends in part upon the diameter of the shaft, the number of other dampers that may be used, and the amount of damping performance required. The width must not be so great as to prevent attachment of the constrained layer damper to the shaft. Typically the width of each damper ranges from about 5 to about 50%, preferably about 10 to about 40%, and most preferably about 10 to about 30% of the circumference of the shaft at each point along the shaft where the damper is attached.

The total thickness of the damper typically ranges from about 0.1 mm to about 5 mm, preferably about 0.2 mm to about 2 mm, and most preferably about 0.2 to about 1.5 mm. If the damper is too thin the amount of damping performance of the damper may be small. If the damper is too thick the damper may contribute too much weight to the golf club.

The total thickness of the vibration damping material layer(s) typically ranges from about 0.025 to about 1 mm, preferably about 0.05 to about 0.5 mm, and most preferably about 0.05 to about 0.38 mm. The thickness of the rigid layer(s) typically ranges from about 0.075 mm to about 4 mm, preferably about 0.15 mm to about 1.5 mm, and most preferably about 0.15 mm to about 1.12 mm.

Typically the number of dampers positioned on the golf club ranges from about 1 to about 40, preferably about 2 to about 20, and most preferably about 2 to about 8.

Preferably, at least one damper is positioned such that approximately the midlength position of the damper coincides with the antinode of the first vibration mode of the club/shaft. The location of the antinode of the vibration mode usually falls between the ¼ to ¾ of the length of the shaft measured from the head. Modal testing or finite element analysis methods can be used to locate the antinode (s) of each vibration mode of interest.

Figure 20:
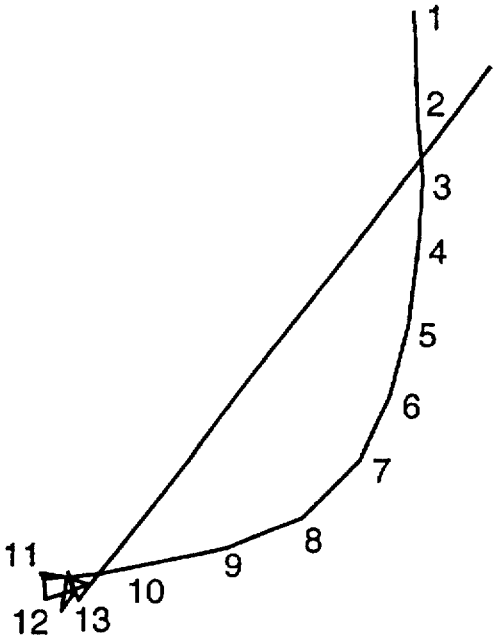
FIG. 20 is a graph illustrating the first vibration mode shape for the golf club of Comparative Example 1 having no dampers attached thereto.
Figure 21:
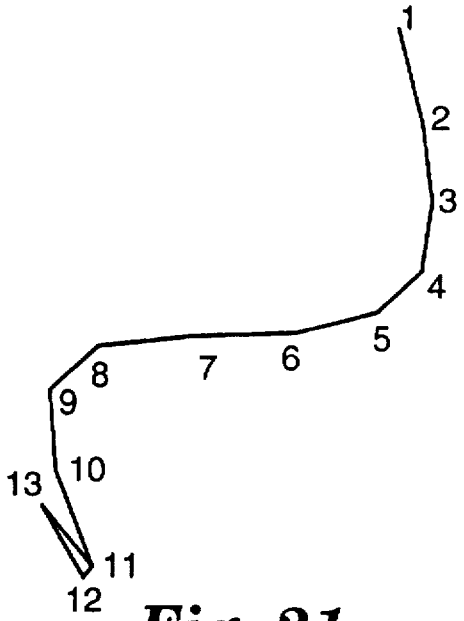
FIG. 21 is a graph illustrating the second vibration mode shape for the golf club of Comparative Example 1 having no dampers attached thereto.
Figure 22:
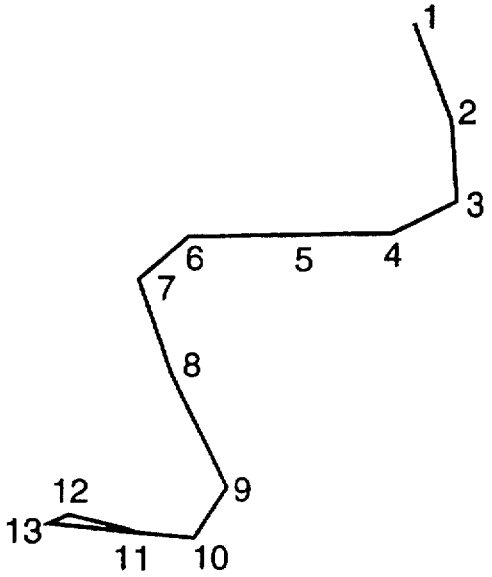
FIG. 22 is a graph illustrating the third vibration mode shape for the golf club of Comparative Example 1 having no damper attached thereto.

A golf club was tested using modal testing techniques to identify the mode shapes for the first three modes found at 56 Hz, 170 Hz, and 337 Hz as shown in FIGS. 20, 21, and 22, respectively. The length of the club was digitized into 11 locations equally spaced along the shaft at approximately 3.5 inches (8.6 cm) increments.

Modal Testing

Modal analysis was conducted on a golf club, Wilson Walker Cup #9 iron. The modal testing was conducted as follows:

The golf club was hung by a thread tied to the grip. An accelerometer (Model No. 303A03 manufactured by PCB Piezotronics, Inc. 3425 Walden Avenue, Depew, N.Y. 14035) was attached at 270° location near the second end of the shaft to measure the vibration response of the golf club. The impact force was also measured when the impact hammer struck at each location. (See FIGS. 20, 21, and 22). The impact hammer Model No. 086B03 manufactured by PCB Piezotronics, Inc. had a force transducer to measure the impact force and was manufactured by PCB Piezotronics, Inc. Signals from the accelerometer and the force transducer were fed into a 10-channel signal conditioner Model No. 483B17 manufactured by PCB. The output signals from the signal conditioner were digitized and analyzed by a Tektronix Fourier Analyzer Model No. 2630 made by Tektronix, Inc., Campbell, Calif., controlled by a Best IBM compatible computer model number 386/25. The digitized data were displayed and stored in the Best Computer. For each location, a graph of the transfer function between the vibration response and impact force versus frequency and a graph of acceleration versus time of the vibration response, were displayed during the test. Using the transfer function data, the mode shapes and modal frequencies were computed using STARModal™ analysis software made by Structural Measurement Systems, Milpitas, Calif., resulting in FIGS. 20, 21, and 22. The best locations(s) for placement of the damper(s) for the golf club of FIG. 20 is from Locations 5–10, for FIG. 21, Locations 7–10 and 2–6, and for FIG. 22, Locations 2–5, 5–8, and 8–11.

It may be possible to have too many dampers and/or too much of the surface area of the shaft covered with dampers. An excess of damper coverage may increase the weight of the club to a degree which would interfere with the player's performance. It may be preferred to attach the dampers to the shaft in a manner which would result in a club which would meet the requirements of the United States Golf Association (USGA) in terms of weight, symmetry, etc.

In order to maximize damping performance it is preferred that at least one damper and preferably all the dampers when more than one is used, be positioned parallel to or fall on a line segment connecting a point on the one end of the shaft to the closest point of the second end of the shaft. (It is not necessary that all the dampers fall on the same line segment, however.) This line segment would be the line segment connecting a point on the one end of the shaft to a point on the opposite end of the shaft at the same degree point on the shaft when viewed in cross-section. For example, a line segment which passes through the 90 degree mark along the length of the shaft can be determined using a grid such as that set forth in FIG. 12. Thus it is preferred that the damper fall on or be parallel (or as close as parallel as possible) to the length of the shaft rather than perpendicular (or close to perpendicular) to the length of the shaft in order to maximize damping performance.

The constrained layer damper can be attached to the shaft of the club, for example, via an adhesive or via the vibration damping material layer of the constrained layer damper if it exhibits sufficient adhesion. Heat and/or pressure can be used, if necessary, in attaching the damper(s) to the shaft. Sometimes, a solvent such as acetone can also be use to assist the bonding between the damper(s) and the shaft.

Ball Bats

The term "ball bats" as used herein is intended to include baseball bats, softball bats, cricket bats, etc. As indicated previously the novel ball bats of the invention have at least one non-tubular constrained layer damper attached thereto. The constrained layer damper(s) may be attached to an internal and/or external surface of the bat. Although external application is preferred for damping reasons, internal application may be preferable for aesthetic reasons. The dampers may be internally applied when, for example, the bat is hollow. When the constrained layer damper(s) are externally applied they may be applied in indentation(s) in the external surface of the bat in order to provide a more aesthetically pleasing appearance and a smooth surface for hitting. The internally applied damper(s) may also be applied in indentation(s) in the bat.

The shape of a damper can vary although it is typically of a symmetrical geometric shape wherein the length is substantially greater than the width and the thickness. The shape of the damper(s) can vary although it is typically of a symmetrical geometric shape. Examples of suitable shapes include but are not limited to those selected from the group consisting of rectangles, triangles, etc. The damper shape may optionally be tapered in order to better fit on the bat since bats are typically tapered. The length of the damper is typically much greater than its width or thickness.

The size (width, length, and thickness) of the constrained layer dampers for use with the bats can vary. Preferably the length of the damper(s) for use with bats ranges from about 10 to about 100 percent of the length of the bat, more preferably about 20 to about 80 percent of the length of the bat and most preferably about 30 to about 60 percent the length of the bat. The longer the damper the typically the better the damping characteristics. Long dampers, however, may excessively increase the weight of the bat and thus interfere with performance. In addition, depending on the specific damping requirements, a long damper may not be necessary to achieve the desired level of damping.

The width of the damper for use with bats can also vary. Preferably the width of the damper ranges from about 5 to about 50, more preferably about 10 to about 80, and most preferably about 25 to about 60 percent of the circumference of the bat at each point along the bat where the damper is attached.

The thickness of the damper(s) for use with bats typically ranges from about 0.2 mm to about 5 mm, preferably about 0.3 mm to about 3 mm, and most preferably about 0.5 to about 3 mm. If the damper is too thin insufficient damping may occur. If the damper is too thick and intended for use in a hollow bat it may not fit into the interior of the bat. In addition, if the damper(s) are too thick the bat may become too heavy for optimum performance.

The total thickness(es) of the vibration damping material layer(s) for dampers to be used with bats typically ranges from about 0.05 mm to about 2 mm, preferably about 0.1 mm to about 1 mm, and most preferably about 0.25 mm to about 1 mm. The thickness of the rigid layer typically ranges from about 0.1 mm to about 4 mm, preferably about 0.2 mm to about 2 mm, and most preferably about 0.4 mm to about 1.5 mm.

Preferably all the layers making up the damper have the same dimensions of length and width.

Typically the number of dampers attached to the bat range from about 1 to about 40, preferably about 2 to about 20, and most preferably about 2 to about 8. As the shape of the bat is typically symmetrical the placement of the damper on the bat when only one damper is used is not as critical as it is in the case of a golf club. It is important that the bat be held by a batter/player such that the damper(s) is placed at the leading surface (the surface contacting the ball) and/or following surface (the surface 180 degrees opposite the leading surface) when one swings the bat to get optimum damping. However, since it is difficult for a batter to concern himself or herself with the damper positioning and, since the damper may not even be visible in the case of an internally damped bat, it is preferable that multiple dampers be positioned around the bat such that at least one damper would be in the leading surface or following surface when used regardless of how the bat is held.

When the bat is constructed of wood rather than metal, for example, it is advantageous if the grain of the wood is taken into consideration when placing the dampers. Most wooden bats have a brand stamped into the wood in a certain position based on the wood grain. Batters are typically instructed to hold the bat such that the brand is facing opposite the side of the striking surface when they swing at the ball to avoid breaking the bat. If the center of the brand is indicated as the 90 degree mark when viewing the bat from the first end to the second end in cross-section on an x-y grid, the preferred ranges for attaching dampers range from 30 to 150 degrees and 210 to 330 degrees (See FIG. 10*a*). It is most preferred to cover the 90 degree mark and/or the 270 degree mark and those areas closest thereto. For example it is preferred that the damper fall somewhere within the 60 to 120 degree range, more preferably somewhere within the 75 to 105 degree range. The wooden interior of the bat is identified as 85 and the brand is identified as 87. These degree ranges are only relevant if the batter holds the bat in a particular manner based on the placement of the brand or other marking on the bat. Otherwise, it is best to have several dampers symmetrically placed about the bat such that one could be sure that good damping properties would be attained regardless of how the bat is held during hitting.

Preferably, at least one damper is positioned such that it extends at least partially along the handle and at least partially along the hitting end of the bat.

It may be possible to have too many dampers and/or too much of the surface area of the bat covered with dampers such that the extra weight could potentially interfere with performance.

The damper(s) should be placed at the location(s) where the vibration damping material will experience large strain and dissipate a large amount of vibration energy. Generally, each damper should be attached to the bat in the range from about 25 percent to about 85 percent of the length of the bat from the hitting end. Preferably, each damper is positioned on the bat such that the constrained layer damper is no more than 50 percent of the length of the bat away from the hitting end of the bat and no more than 40 percent of the length of the bat away from the handle of the bat.

Preferably, at least one damper is positioned such that the position of the damper coincides with the antinode of the first vibration mode of the bat. The location of the antinode usually falls within an area which is between ¼ to ¾ the length of the bat away from either end of the bat, and thus this a preferable location for attachment of damper(s). Modal testing and finite element analysis methods can be used to locate the antinode(s) for each vibration mode of the bat and aid in the selection of the locations for attaching the damper(s).

In order to maximize damping performance it is preferred that at least one damper and preferably all the dampers when more than one is used, be positioned parallel to or fall on a line segment connecting a point on the one end of the bat adjacent to the handle to the closest point of the second end of the bat. If the bat has a knob at the end of the handle it is most convenient to measure from a point adjacent to the handle to the opposite end of the bat. (It is not necessary that all the dampers fall on the same line segment, however.) This line segment would be the line segment connecting a point on the one end of the bat to a point on the opposite end of the bat when viewed in cross section. Thus it is preferred that the damper fall on or be parallel (or as close as parallel as possible) to the length of the bat rather than perpendicular (or close to perpendicular) to the length of the bat in order to maximize damping performance.

The constrained layer damper is typically attached to the bat via an adhesive or via the damping material layer of the constrained layer damper if it exhibits sufficient adhesion. Heat and/or pressure can be used, as necessary, in attaching the damper to the bat. Sometimes, a solvent such as acetone can also be used to assist the bonding between the damper and the bat. Other methods of attachment are also foreseen.

This invention will be better understood by referring to the following figures.

Figure 1:
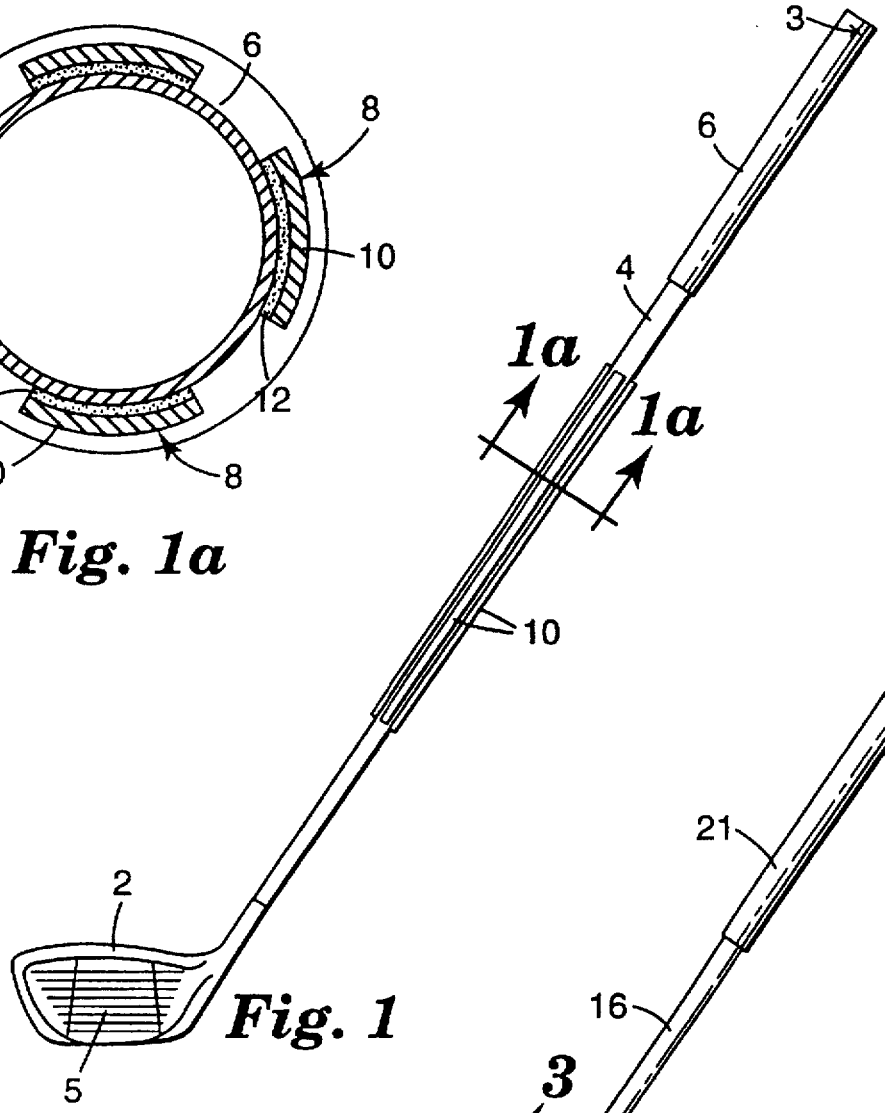
FIG. 1 illustrates a side view of an embodiment of the novel golf club of the invention.

FIG. 1 illustrates a side view of an embodiment of the novel golf club of the invention. The golf club has a striking head 2, a shaft 4, and a grip 6. Four constrained layer dampers 8 are attached to the exterior surface of the shaft 4 of the club. Each constrained layer damper 8 comprises a vibration damping material layer 12 and a rigid layer 10. In order to conduct a vibration test on the golf club of FIG. 1, or another golf club as discussed in the Examples, an accelerometer would be positioned at a point corresponding to point 3 on the golf club of FIG. 1. The point of impact would be at a point corresponding to point 5 on the golf club of FIG. 1.

FIG. 1*a* illustrates a cross section of the golf club of FIG. 1 taken along line 1*a*—1*a*.

Figure 2:
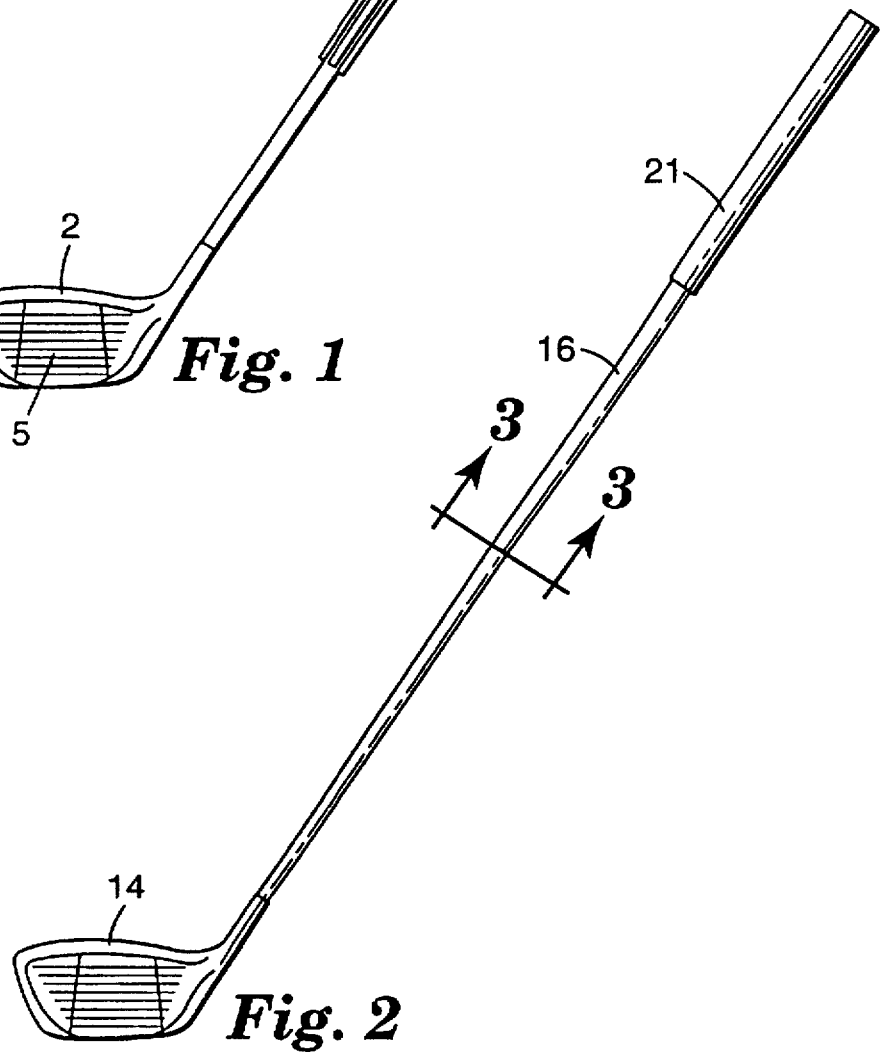
FIG. 2 illustrates a side view of another embodiment of the novel golf club of the invention.

FIG. 2 illustrates a side view of another embodiment of the novel golf club of the invention. The golf club has a striking head 14, a shaft 16, and a grip 21. Two constrained layer dampers 20 (not shown) are attached to the interior surface of the shaft 16 of the club. Each constrained layer damper 20 comprises a vibration damping material layer 24 and a rigid layer 22.

Figure 3:
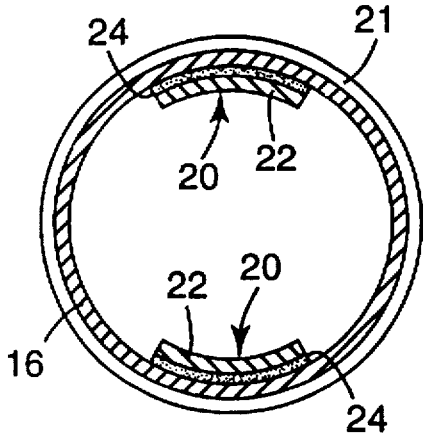
FIG. 3 illustrates a cross-sectional view taken along line 3—3 of FIG. 2.

FIG. 3 illustrates a cross-sectional view taken along line 3—3 of FIG. 2. The cross-section shows constrained layer dampers 20 attached to the interior of the shaft 16 of the club.

Figure 3A:
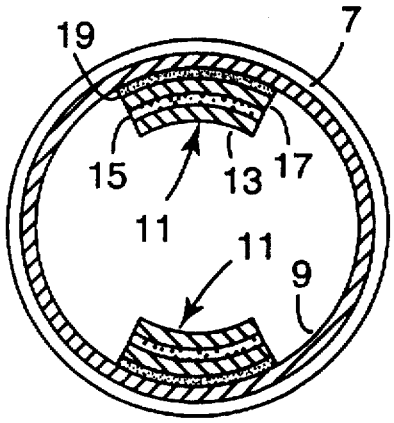
FIG. 3*a* illustrates a side view of another embodiment of the novel golf club of the invention.

FIG. 3*a* illustrates a cross-sectional view of another embodiment of a golf club of the invention which shows constrained layer dampers 11 attached to the interior surface of the shaft 9 of the club. Each constrained layer damper 11 comprises two vibration damping material layers 15 and 19 and two rigid layers 13 and 17. The grip is identified as 7.

Figure 4:
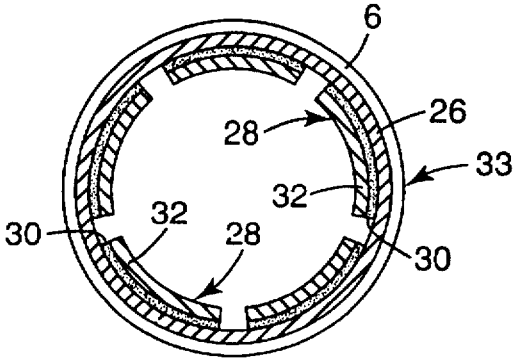
FIG. 4 illustrates a cross-sectional view of another embodiment of a golf club of the invention taken along the shaft of the golf club.

FIG. 4 illustrates a cross-sectional view of another embodiment of a golf club of the invention taken along the shaft 26 of the golf club. Five constrained layer dampers 28 are attached to the interior of the shaft 26. Each constrained layer damper 28 comprises a rigid layer 32 and a vibration damping material layer 30. Each constrained layer damper 28 covers a 60 degree range. The total degrees covered around the circumference are thus 300. The grip is identified as 33.

Figure 5:
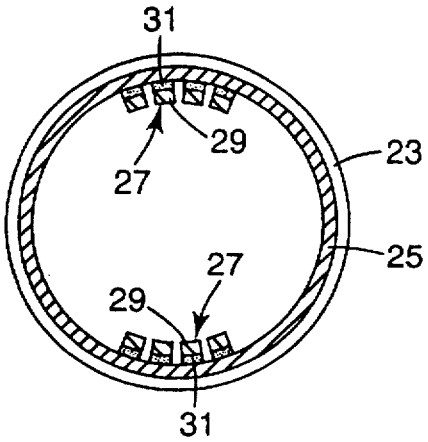
FIG. 5 illustrates a cross-section of an embodiment of a novel golf club of the invention.

FIG. 5 illustrates a cross section of another embodiment of a novel golf club of the invention. The golf club comprises shaft 25 and eight constrained layer dampers 27. Each constrained layer damper 27 comprises a layer of vibration damping material 31 and rigid layer 29. The dampers 27 are attached to the interior surface of the shaft 25. The grip is identified as 23. Each constrained layer damper 27 covers about a 9 degree range on the circumference of the shaft. Since eight dampers 27 are positioned on the shaft the total degrees covered are 72.

Figure 6:
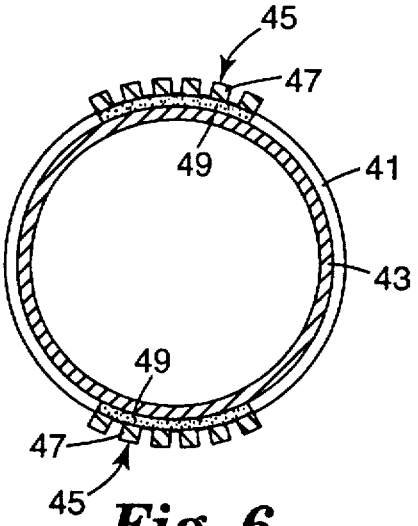
FIG. 6 illustrates a cross-section of an embodiment of a novel golf club of the invention.

FIG. 6 illustrates a cross section of another embodiment of a novel golf club of the invention. The golf club comprises shaft 43 and two constrained layer dampers 45. Each constrained layer damper 45 comprises a layer of vibration damping material 49 and rigid layer strips 47. The dampers 45 are applied to the exterior surface of the shaft 43. The grip is identified as 41. Each damper 45 covers a 57 degree range on the circumference of the shaft. Thus the total degrees covered on the circumference of the shaft are 114. The damper dimensions of degrees covered is defined by the vibration damping material 49 dimensions not the dimension of the rigid layer strips 47 attached thereto when the area of the damping material differs from the area of the rigid layer. This calculation based on the vibration damping material dimensions is true for other golf clubs of the invention and also for bats of the invention.

Figure 7:
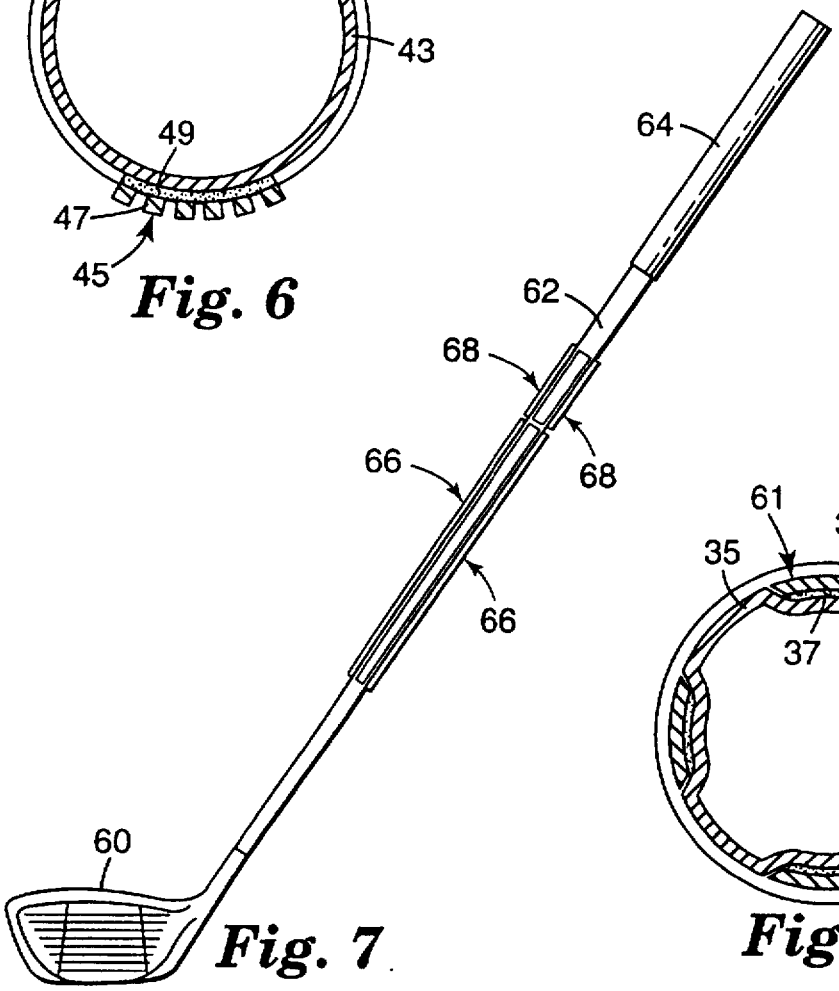
FIG. 7 illustrates a side view of another embodiment of the novel golf club of the invention.

FIG. 7 illustrates a side view of another embodiment of the novel golf club of the invention having a striking head 60, a shaft 62, and a grip 64. Four long constrained layer dampers 66 comprising a vibration damping material layer and a rigid layer are attached to the shaft 62. Four shorter constrained layer dampers 68 comprising a damping layer and a rigid layer are also attached to the shaft 62.

In some situations the same degree ranges may be covered by two or more separate dampers. For example, in FIG. 7 the shorter dampers 68 are positioned identically around the shaft 62 circumference as longer dampers 66. Suppose the eight dampers are positioned such that two (one short damper 68 and one long damper 66) fall entirely in the 60 to 120 degree range, two (one short damper 68 and one long damper 66) encompass the 150 to 210 degree range, two (one short damper 68 and one long damper 66) encompass the 240 to 300 degree range, and two (one short damper 68 and one long damper 66) encompass the 330 to 30 degree range. The total degree range covered would just be considered to be four times 60 which equals 240, since the additional four dampers along the length did not extend the degrees covered around the circumference of the shaft.

Suppose, however, an article exists where one damper attached to the middle of the shaft covers a degree range of 70 to 100 degrees, and that another damper attached lower on the shaft covers a degree range of 90 to 115 degrees. The total degree range covered would be considered to be 45, since the entire range 70 to 115 is covered by a damper at least somewhere on the shaft. If an additional damper was present on the shaft, further up the shaft towards the grip than the other two, but covering a degree range of 290 to 300, the total degree range would thus be considered to be 45 plus 10, or thus 55 degrees total. Thus, in calculating degree ranges the position of the damper(s) with respect to their distance from either end of the shaft is not taken into account just the number of degrees covered on the circumference on the shaft. However, as discussed elsewhere herein the positioning of the damper(s) from either end of the shaft does effect damping properties also.

Figure 8:
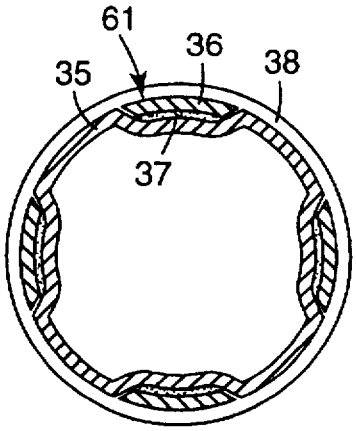
FIG. 8 illustrates a cross-sectional view of another embodiment of the novel golf club of the invention.

FIG. 8 illustrates a cross-sectional view of another embodiment of the novel golf club of the invention having shaft 35 and grip 38. Constrained layer dampers 61 comprising rigid layer 36 and vibration damping material layer 37 are attached to the exterior of the shaft 65 in indentations present therein.

Figure 9:
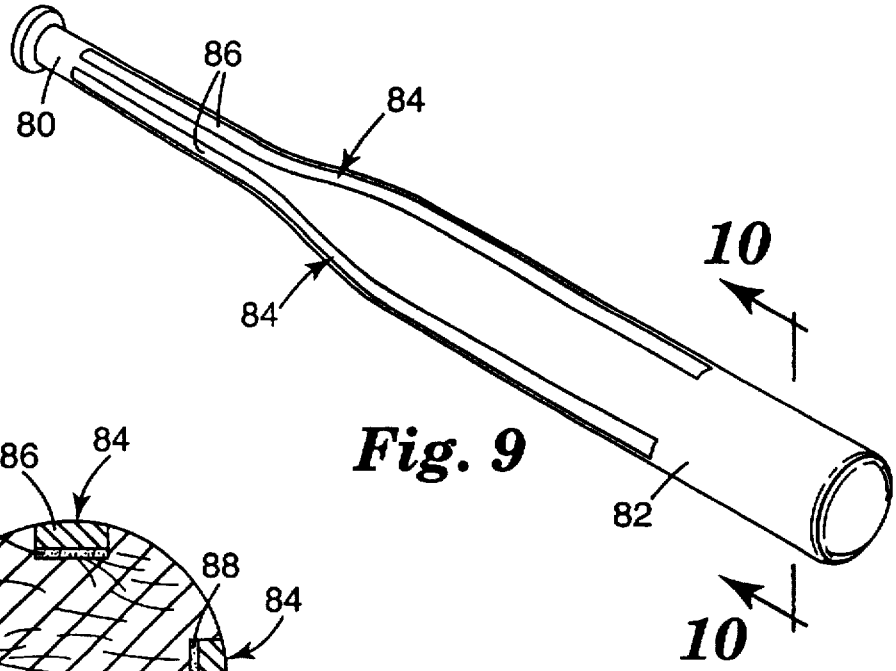
FIG. 9 illustrates a perspective view of an embodiment of a novel bat of the invention.

FIG. 9 illustrates a perspective view of an embodiment of a novel bat of the invention having a handle 80 and a hitting end 82. Four dampers 84 are positioned within indentations in the exterior surface of the bat. Each damper 84 comprises vibration damping material layer 88 (not shown) and rigid layer 86.

Figure 10:
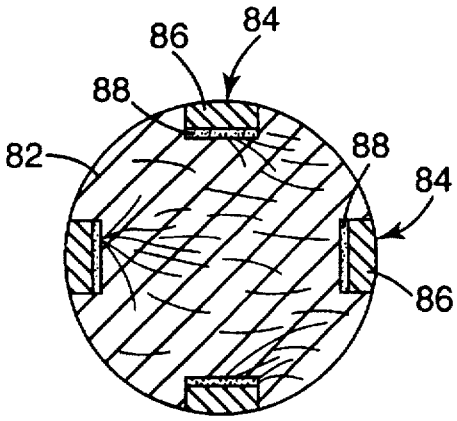
FIG. 10 illustrates a cross-sectional view taken along line 10—10 of FIG. 9.
Figure 10A:
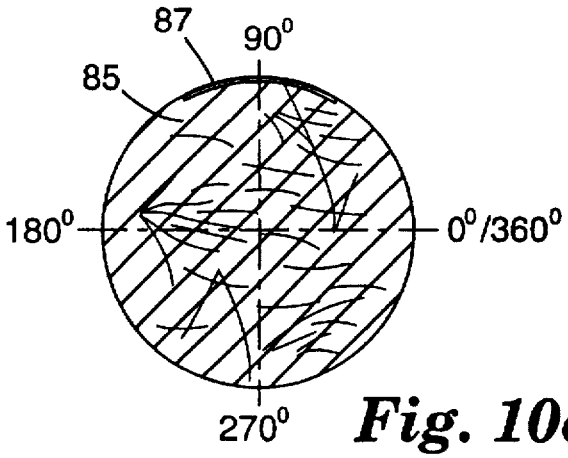
FIG. 10*a* illustrates a cross-sectional view of a solid wooden bat on an x-y grid.

FIG. 10 illustrates a cross-sectional view taken along line 10—10 of FIG. 9.

Figure 11:
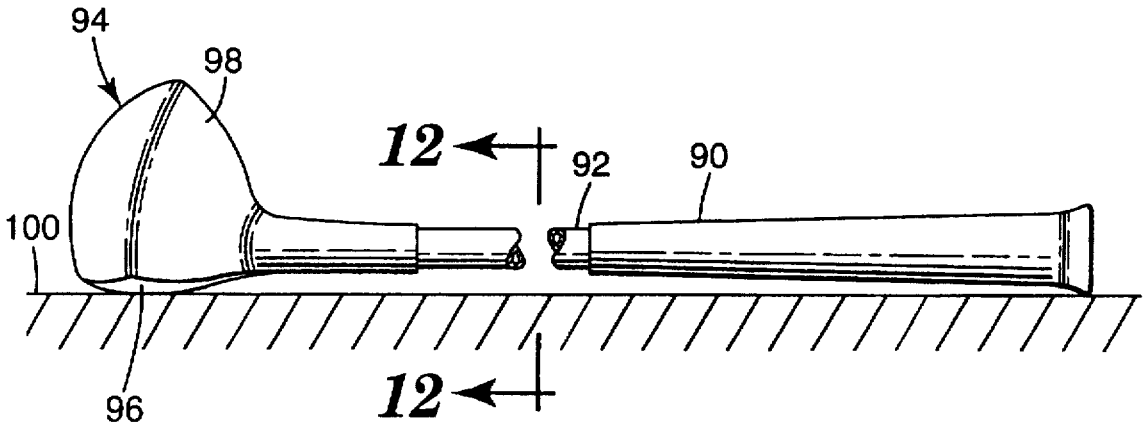
FIG. 11 illustrates an elevational side view of a golf club with the striking surface face down on a flat surface.

FIG. 11 illustrates an elevational side view of a golf club having a gripping end 90, a shaft 92, and a striking head 94. The striking head has a front surface 96 and a back surface 98, the front surface 96 being the striking surface. The club is placed on a flat surface 100 with the striking surface 96 face down on the flat surface 100.

Figure 12:
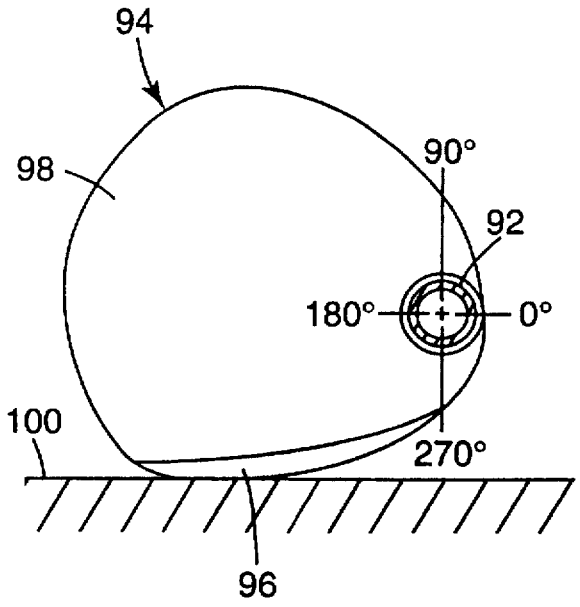
FIG. 12 is taken along line 12—12 of FIG. 11. This figure helps to illustrate the optimum damper placement, which is discussed elsewhere herein.

FIG. 12 is taken along line 12—12 of FIG. 11. This figure helps to illustrate the optimum damper placement, which is discussed elsewhere herein. The 0/360 degree mark is on one side of the shaft in such a position where the striking head is attached to the shaft. The 90 degree mark is on the top most portion of the shaft. The 270 degree mark is on the bottom most portion of the shaft. The 180 degree mark is on the side of the shaft opposite the 0/360 degree mark.

Preferably, at least one damper is attached to the shaft such that (1) at least a 30 degree range total is covered in the 60 to 120 degree range, or (2) at least a 30 degree range total is covered in the 240 to 300 degree range, or (3) at least a 30 degree range is covered total within the 60 to 120 degree range plus the 240 to 300 degree range. More preferably the 75 to 105 degree range is covered, or the 255 to 285 degree range is covered, or the 75 to 105 degree range plus the 255 to 285 degree range is covered.

More preferably at least one damper must be positioned on the shaft such that (1) at least a 60 degree range total is covered by vibration damping material layer(s) of the damper(s) in the 60 to 120 degree range, (2) at least a 60 degree range total is covered in the 240 to 300 degree range, (3) or at least a 60 degree range is covered within the 60 to 120 degree range plus the 240 to 300 degree range.

For example, suppose the damper is of a rectangular shape which has been curved to better fit on the golf club shaft. Suppose the damper when positioned on the shaft extends over a 50 degree range. If the damper is centrally positioned such that its center is at the 90 degree mark this would be preferable, since the damper would extend from the range of 65 degree mark to the 115 degree mark. Thus, a 50 degree range in the 60 to 120 range would be covered which more than meets the minimum preferred requirement of 30 degrees. It would be similarly preferable if a damper was centrally positioned such that its center is at the 270 degree mark since the damper would extend from the range of the 245 degree mark to the 295 degree mark. Thus a 50 degree range in the 240 to 300 degree range would be covered which more than meets the minimum preferred requirement of 30 degrees.

It would also be preferred, although less preferred than the previously described situation, if the damper would extend such that one end is positioned on the 90 degree mark and the other end is positioned on the 40 degree mark since at least one 30 degree section between the degrees 60 and 120 still has a damper attached thereto.

It would be acceptable, but not preferred however, if a damper capable of covering 60 degrees was positioned such that its center point was on the 0 degree mark since a 30 degree section between 60 and 120 degrees on the front of the shaft and a 30 degree section between about 240 and 300 degrees on the back of the shaft would not have a damper attached thereto.

With respect to the preferred damper requirements, it does not matter if the damper extends beyond the 60 degree to 120 degree range or the 240 degree to 300 degree range, subject to any other limitations set forth herein (such as weight, etc.), as long as the minimum range requirements are met.

These minimum preferred range requirements can be met by a combination of more than one damper. For example, two dampers, both of which are rectangular except that they are curved to better fit on the shaft can be used. Suppose one damper covers a 10 degree section from 70 to 80 degrees and a second damper covers a 20 degree section from 90 to 110 degrees. Although neither damper covers the preferred 30 degree range by itself, 30 degrees total are covered within the range of 60 to 120 degrees.

Another way in which a total preferred degree requirement may be met is by placing one damper capable of covering a 10 degree area in the range of 60 to 120 degrees and another damper capable of covering a 20 degree area somewhere in the range of 240 to 300 degrees. Neither damper alone covers 30 degrees by itself within a designated area, but in total they cover 30 degrees in the designated areas.

Preferably at least one constrained layer damper is positioned on the shaft such that it is centrally located on the side of the shaft that is visible when viewing the striking surface of the striking head and/or on the side of the shaft that is visible when viewing the back surface of the striking head.

Figure 13:
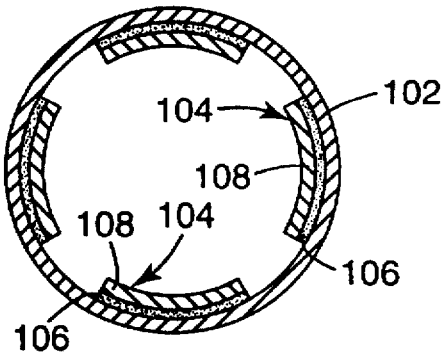
FIG. 13 illustrates a cross-sectional view of an embodiment of a novel bat of the invention.

FIG. 13 illustrates a cross-sectional view of an embodiment of a novel hollow bat of the invention comprising hitting end 102 and constrained layer dampers 104. The constrained layer dampers 104, which are attached to an interior surface of the bat, each comprises a rigid layer 108 and a vibration damping material layer 106.

Figure 14:
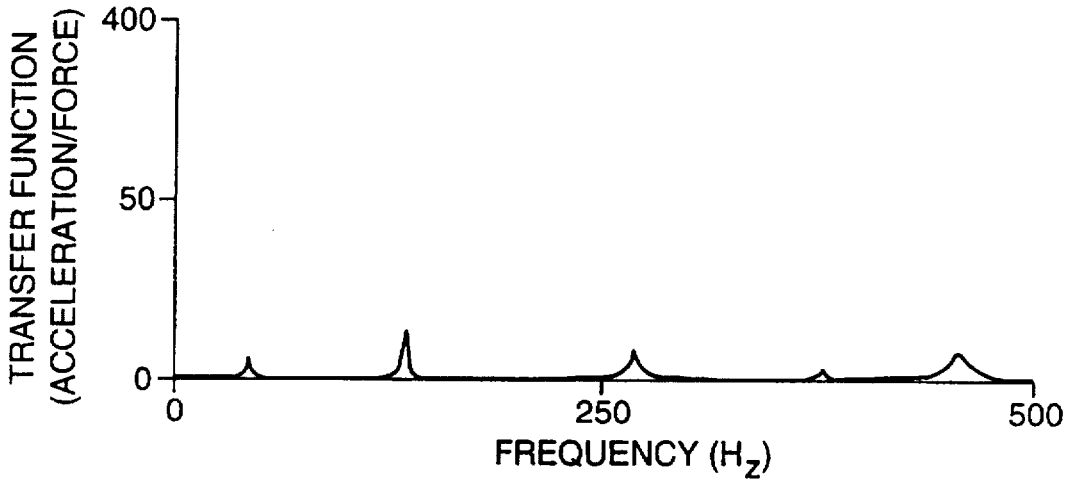
FIG. 14 is a graph illustrating the transfer function in the frequency domain of the damped golf club of Example 2 with the acceleration measured at the 270 degree location of the second end of the shaft and the impact force at the striking surface of the golf club.
Figure 16:
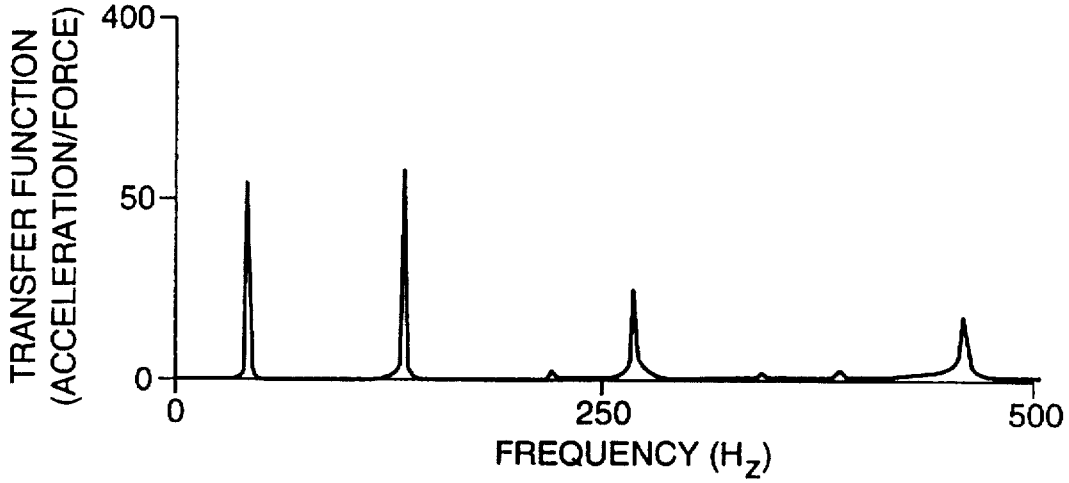
FIG. 16 is a graph illustrating the transfer function for the golf club of Comparative Example 1 having no dampers attached thereto.
Figure 18:
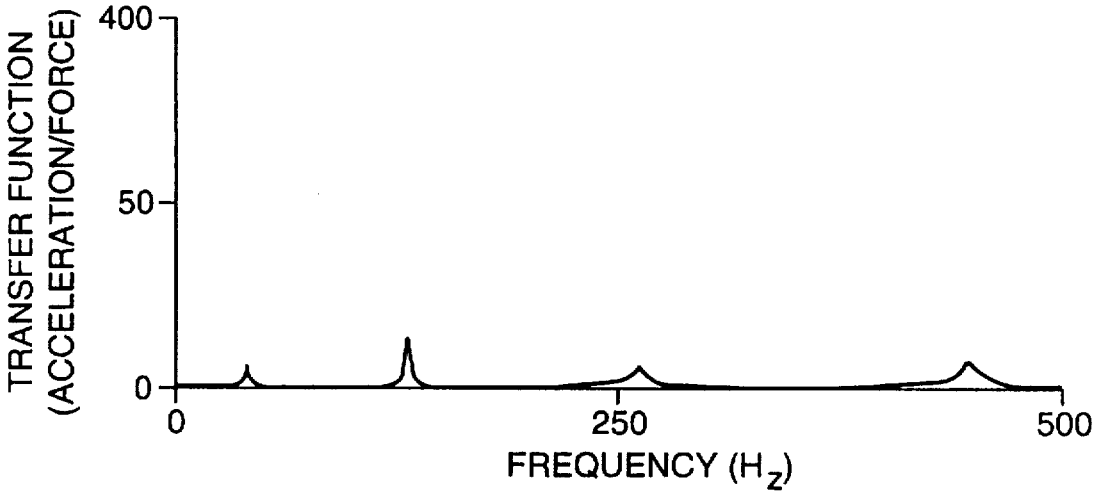
FIG. 18 is a graph illustrating the transfer function for a golf club having four dampers attached thereto made according to Example 1.

FIGS. 14, 16 and 18 are transfer function versus frequency graphs for Example 2, Comparative Example 1, and Example 1, respectively.

Figure 15:
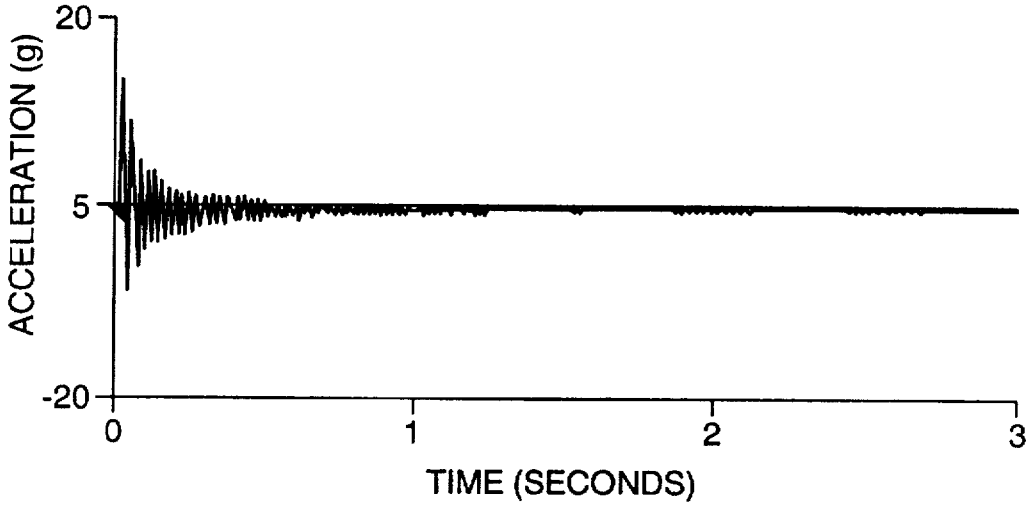
FIG. 15 is a graph illustrating the acceleration response at the second end of the shaft versus time due to an impact to the striking surface of a damped golf club having two dampers made according to Example 2.
Figure 17:
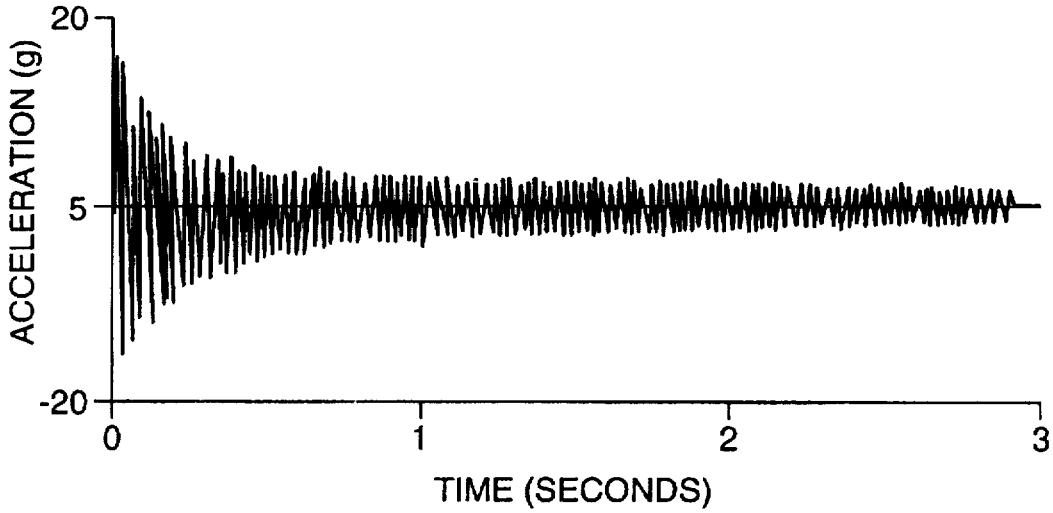
FIG. 17 is a graph illustrating the acceleration response versus time for the golf club of Comparative Example 1 having no dampers attached thereto.
Figure 19:
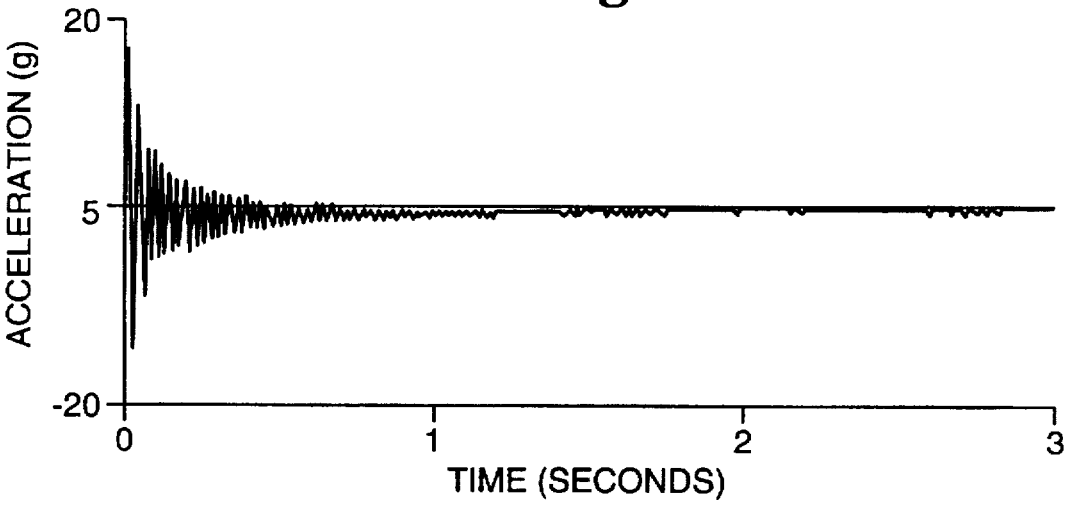
FIG. 19 is a graph illustrating the acceleration response versus time for a golf club having four dampers attached thereto made according to Example 1.

FIGS. 15, 17, and 19 are acceleration versus time graphs for Example 2, Comparative Example 1, and Example 1, respectively.

FIG. 20 is a graph illustrating the first vibration mode shape for the golf club of Comparative Example 1 having no dampers attached thereto wherein 1 is at the second end of the club and 13 is at the first (striking head) end of the club.

FIG. 21 is a graph illustrating the second vibration mode shape for a golf club of Comparative Example 1 having no dampers attached thereto wherein 1 is at the second (grip) end of the club and 13 is at the first (striking head) end of the club.

FIG. 22 is a graph illustrating the third vibration mode shape for a golf club of Comparative Example 1 having no dampers attached thereto wherein 1 is at the second (grip) end of the club and 13 is at the first (striking head) end of the club.

The best location(s) for placement of damper(s) for the golf club of FIG. 20 is from Locations 5–10, for FIG. 21 Locations 7–10 and 2–6, and for FIG. 22 Locations 2–5, 5–8, and 8–11.

Figure 23:
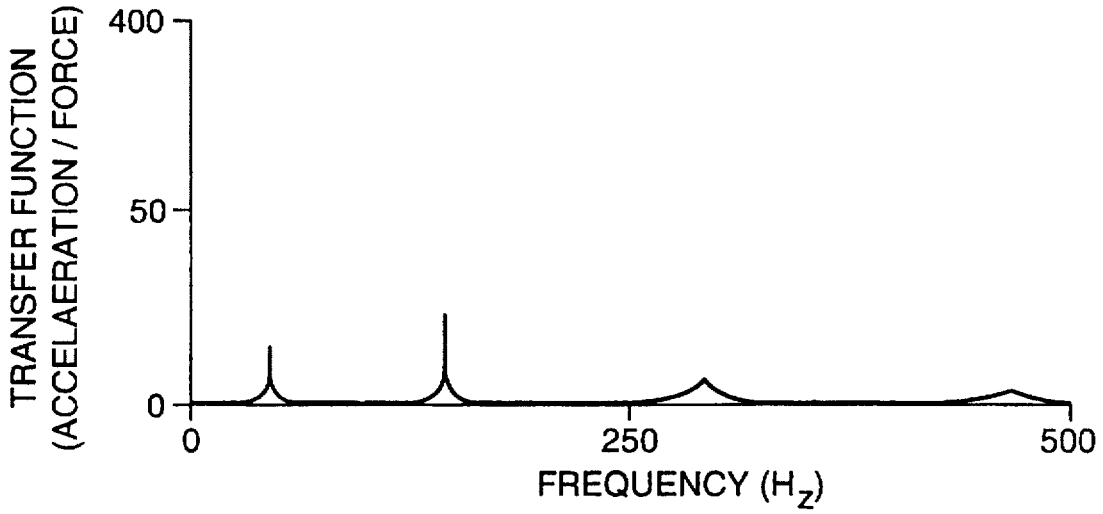
FIG. 23 is a graph illustrating the transfer function with the acceleration measured at the 270 degree location of the second end of the shaft and the impact force at the striking surface of the golf club for the damped golf club of Example 3 having two internal dampers attached thereto.

FIG. 23 is a graph illustrating the transfer function with the acceleration measured at the 270 degree location of the second end of the shaft and the impact force at the striking surface of the golf club for the damped golf club of Example 3 having two internal dampers attached thereto.

Figure 24:
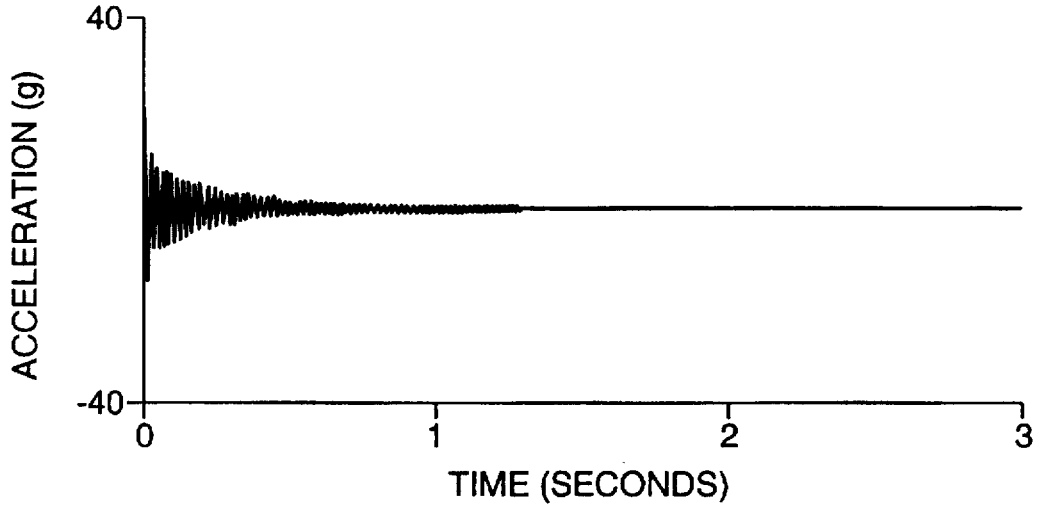
FIG. 24 is a graph illustrating the acceleration response at the second end of the shaft versus time due to an impact to the striking surface of a damped golf club having two dampers made according to Example 3.

FIG. 24 is a graph illustrating the acceleration response at the second end of the shaft versus time due to an impact to the striking surface of a damped golf club having two dampers made according to Example 3.

Figure 25:
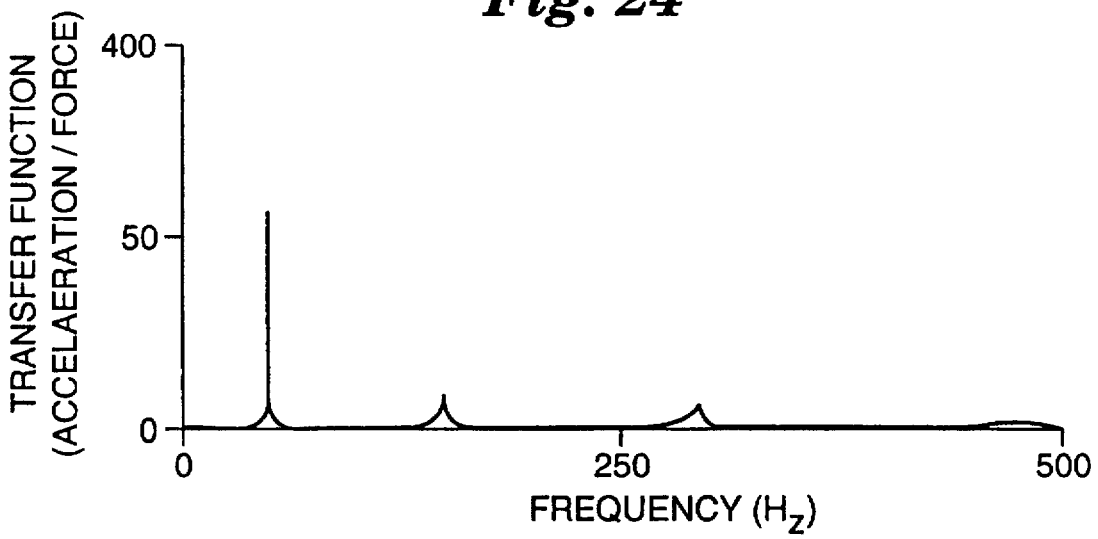
FIG. 25 is a graph illustrating the transfer function for the golf club of Comparative Example 3 having no dampers attached thereto.

FIG. 25 is a graph illustrating the transfer function for the golf club of Comparative Example 3 having no dampers attached thereto.

Figure 26:
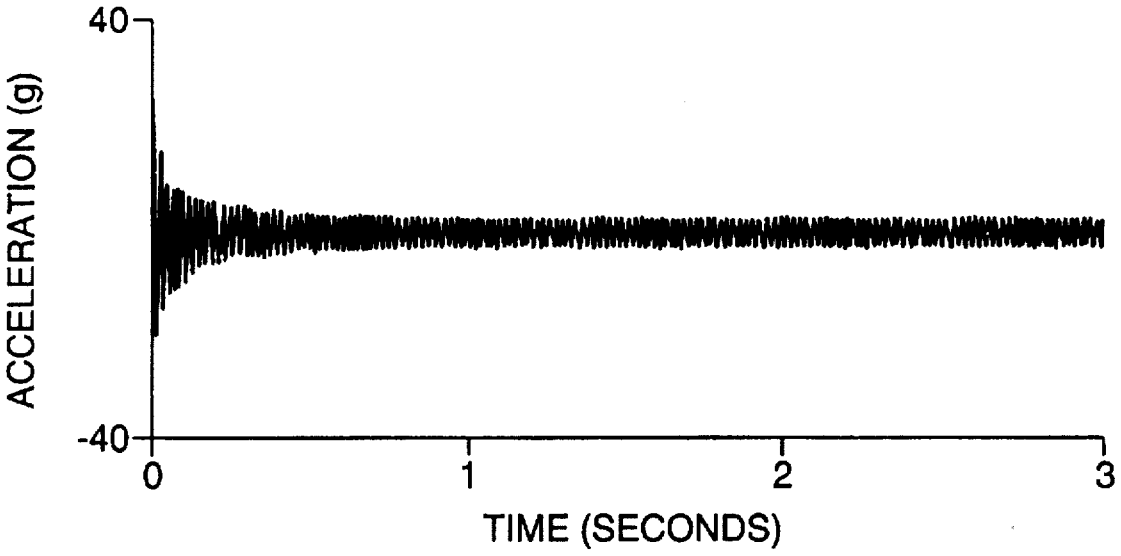
FIG. 26 is a graph illustrating the acceleration response versus time for the golf club having no dampers made according to Comparative Example 3.

FIG. 26 is a graph illustrating the acceleration response versus time for the golf club having no dampers made according to Comparative Example 3.

Figure 27:
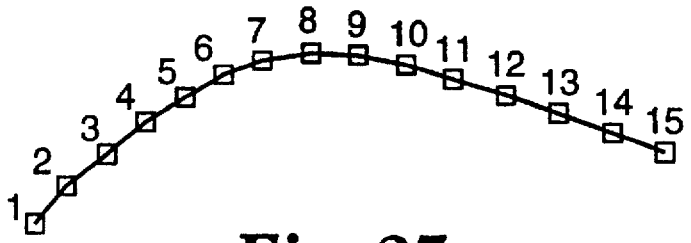
FIG. 27 is a graph illustrating the first vibration mode shape for the ball bat of Comparative Example 4 at 185 Hz.

FIG. 27 is a graph illustrating the first vibration mode shape for the ball bat of Comparative Example 4 at 185 Hz.

Figure 28:
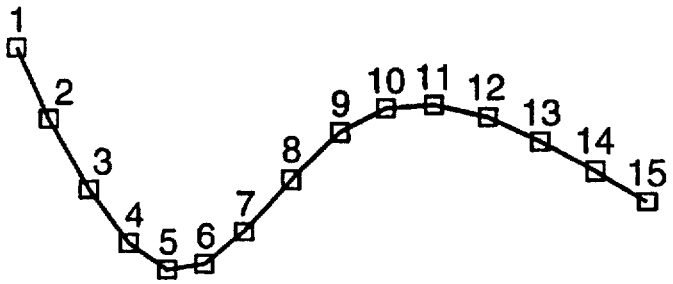
FIG. 28 is a graph illustrating the second vibration mode shape for the ball bat of Comparative Example 4 at 572 Hz.

FIG. 28 is a graph illustrating the second vibration mode shape for the ball bat of Comparative Example 4 at 572 Hz.

EXAMPLES

The following examples further illustrate but do not limit the present invention.

Example 1

Externally Damped Golf Club Having Four Dampers

Preparation of Constrained Layer Dampers:

First, a rectangular aluminum sheet, 0.38 mm thick, 16 mm wide and 320 mm long was provided. Then, with a paper cutter, a sheet of 3M™ ISD 112 acrylic viscoelastic polymer, 0.25 mm thick, 16 mm wide, and 320 mm long was cut from a larger sheet of the material. The viscoelastic material has pressure sensitive adhesive properties at room temperature (24 degrees C.). One side of the viscoelastic material had a paper release liner on it. The side of the viscoelastic material sheet not having the release liner was placed onto the aluminum sheet and rolled down with a 0.16 kg rubber roller, making sure that minimal air was trapped between the viscoelastic material and the aluminum sheet. The viscoelastic material/aluminum sheet composite was then cut into four 4 mm wide and 320 mm long constrained layer dampers.

Placement of the Four Constrained Layer Dampers on the External Surface of the Golf Club Shaft:

The golf club used was a Wilson™ 1200 GC 1 iron. First, a clean cloth was used to wipe the surface of the shaft. Then, the release liner was peeled off from the viscoelastic material of one of the constrained layer dampers described above. The constrained layer damper was placed on the external surface of the golf shaft wherein its center line extending the length of the damper coincided with the line along the shaft at 270°. The viscoelastic material side of the constrained layer damper was placed against the golf shaft external surface. The damper extended along the shaft length at a position beginning at 48 cm and ending at 80 cm as measured from the second end of the shaft (i.e., where the grip is situated). Similarly, the other three dampers were positioned on the shaft such that their longitudinal center lines were at the 0°, 90° and 180° locations, respectively, of the shaft at the same lengthwise location. A 0.16 kg rubber roller was used to help adhere the dampers to the shaft surface.

Example 2

Externally Damped Golf Club Having Two Dampers

The novel damped golf club of this Example was prepared by removing two of the four dampers from the golf club of Example 1. The two dampers removed were those at the 0 degree and 180 degree positions.

Comparative Example 1

Golf Club Having No Dampers

This example employed the same golf club of claim 1 but without any constrained layer dampers attached thereto.

Vibration Testing

Vibration tests were conducted on the golf clubs of Examples 1–2 and Comparative Example 1. The tests were conducted as follows:

Each golf club was hung by a rubber band tied to the grip. An accelerometer (Model No. 303A03 manufactured by PCB Piezotronics, Inc. 3425 Walden Avenue, Depew, N.Y. 14035) was attached at 270° location near the second end of the shaft to measure the vibration response of the golf club when the striking head of the golf club was hit at the center of the ball striking surface by an impact hammer. (See FIG. 3 wherein the attachment point to the accelerometer corresponds to point 3 and the striking point corresponds to point 5.) The impact hammer Model No. 086B03 manufactured by PCB Piezotronics, Inc. had a force transducer to measure the impact force and was manufactured by PCB Piezotronics, Inc. Signals from the accelerometer and the hammer were fed into a 10-channel signal conditioner Model No. 483B17 manufactured by PCB. The output signals from the signal conditioner were digitized and analyzed by a Tektronix Fourier Analyzer Model No. 2630 made by Tektronix, Inc., Campbell, Calif., controlled by a Dell IBM compatible computer Model No. DL590XM made by Dell Computer Corporation, Austin, Tex. The digitized data were displayed and stored in the Dell Computer. A graph of the transfer function between the vibration response and impact force versus frequency and a graph of acceleration versus time of the vibration response, were displayed during the test.

FIGS. 16 and 17 relate to Comparative Example 1 which has no dampers. FIG. 16 shows the transfer function between the acceleration and the impact force over a frequency range of 0 to 500 Hz. The term "transfer function" as used herein refers to the response/exciation dynamics relationship between the vibration response at the second end and excitation at the head of the club. Additional information on the transfer function can be found in "Elements of Vibration Analysis" by L. Meirovitch, page 97, McGraw-Hill, New York, 1986, incorporated by reference herein. Four distinct peaks or vibration modes could be identified from the plot. For this club the lowest vibration modal frequency which usually contains most of the vibrational energy and may be the most annoying vibration mode to players was 41 Hz. FIG. 17 shows a very slow decay in acceleration (longer than 3 seconds) after an impact since the damping in the golf club having no constrained layer dampers was very small.

FIGS. 18 and 19 relate to Example 1. FIGS. 18 and 19 show the transfer function and the acceleration, respectively, measured for the golf club of Example 1 with four constrained layer dampers attached thereto. The vibration energy was significantly reduced due to the added dampers to the club. The magnitudes of the four peaks of the transfer function were all significantly reduced as shown in FIG. 18. The club vibration energy quickly decayed to a minimum value in one second after impact as shown in FIG. 19.

FIGS. 14 and 15 relate to Example 2. It can be seen that even when the damping strips at the locations 0° and 180° are removed there is insignificant decrease in the vibration damping performance of the club. Since added weight from the damper(s) to the golf club is a significant concern to the player, it is preferable to place damper(s) at locations that can produce the most efficient damping.

Example 3

Damped Golf Club Having Two Internally Positioned Constrained Layer Dampers

Preparation of Constrained Layer Dampers:

The rigid layers were prepared as follows. Ten layers of 0.13 mm thick, 150 mm wide, and 533 mm long 3M Scotchply™ SP 500 composite prepreg (commercially available from 3M company, St. Paul, Minn.) were placed between two 1.5 mm thick, 203 mm wide, and 610 mm long steel plates. Each steel plate was wrapped with a 0.02 mm thick release liner to prevent the composite prepreg from bonding to the steel plate. The whole assembly was then placed into a folded rubber pad having an opening for a hose and then in an oven at 96 degrees C. for 30 minutes. A thermal resistant cloth was inserted between the rubber and wrapped steel plate to prevent the air from trapping in between. Before subjecting the assembly to heat, the rubber pad was sealed, connected via a hose to a vacuum pump, and subjected to a vacuum of 380 mm Hg. The whole assembly was removed from the oven, cooled down to room temperature and the rigid layer was placed on a diamond cutting machine and cut to make two 4 mm by 330 mm rigid layers having an average thickness of 1.3 mm. One side of the rigid layer was then sanded using sand paper to a curvature that was similar to that of the internal surface of the shaft where the damper was attached. A 0.13 mm thick 3M™ ISD 112 acrylic viscoelastic polymer sheet with a release liner on one side was then attached via the liner free side to the sanded surface of each rigid layer. The total weight of the two dampers without the release liner was 4.88 grams.

Attaching the Constrained Layer Dampers to the Interior of the Shaft:

The two dampers were temporarily attached along the external surface of a smaller golf shaft which had a diameter less than that of the golf club shaft with the rigid layer adhered to the smaller shaft using a pressure sensitive spray adhesive (3M Scotch™ Brand Spray Mount™, catalog number 6065). The centerlines of the two dampers were 180 degrees apart along the circumference of the shaft in which the dampers were attached. The shaft with the dampers were then inserted into a 990 mm long golf club. The outer diameters of the first and second ends of the shaft were 9.5 and 15.4 mm respectively and the thicknesses of the steel were 0.50 mm and 0.36 mm respectively. The dampers were firmly pressed against the internal surface of the shaft. The shaft was wetted with acetone before the dampers were inserted. The smaller shaft was then pulled out. A hot air blower was used to dry the acetone inside the shaft until the dampers were firmly attached to the shaft. The dampers were positioned from 25 cm to 58 cm from the first end of the shaft.

Making the Golf Club:

A Wilson Ultra system 45 Iron #1 head was attached to the first end of the damped shaft. The center lines of the two dampers were in the vicinity of the 90 degrees and 270 degrees locations respectively. No grip was attached to the shaft for the following tests.

The same testing set up was used to test the club with and without (Comparative Example 3 club with no dampers) the added constrained layer dampers. FIG. 23 shows the transfer function in frequency domain between the excitation force at the head and the acceleration response at the second end of the damped club. The first peak was smaller compared to those corresponding peaks shown in FIG. 25 for the undamped club. For the first vibration frequency at 46 Hz a reduction in magnitude of about four-fold was observed. FIG. 24 shows the acceleration time history due to an impact at the head of the damped club. The vibration quickly decayed as compared to that shown in FIG. 26 for the undamped club.

Comparative Example 4

Comparative Ball Bat Example

A wooden base ball bat was tested using modal testing techniques similar to those described previously for modal testing on a golf club to identify the mode shapes for the first two modes found at 185 Hz and 572 Hz as shown in FIGS. 27 and 28 respectively. The length of the bat was digitized into 15 locations. Location 15 was the first end (hitting end) and Location 1 was the second end (handle end).

Example 4

Externally Damped Ball Bat

Two constrained layer dampers which were 180° apart were attached to the outside surface of the bat. Each damper consisted of two 9.5 mm wide sub-dampers 1 side-by-side covered by a 15.9 mm wide sub-damper 2. All sub-dampers were made of 0.25 mm thick aluminum and 0.25 mm thick 3M™ ISD 112 acrylic viscoelastic polymer. The two dampers were placed from Location 3 to Location 11.

Vibration tests were conducted using the same set-up as shown in the Comparative Example 4. The accelerometer was placed at Location 2 to measure vibration response due to an impact at Location 13. It was found that the damping ratios calculated from the half-power method (as shown on page 54 of Meirovitch, "Elements of Vibration Analysis", 1986) of the two vibration modes increased from 0.7% and 0.4% to 2.6% and 2.4% respectively.

The foregoing detailed description and examples have been given for clarity of understanding only. No unnecessary limitations are to be understood therefrom The invention is not limited to the exact details shown and described, for variations obvious to one skilled in the art will be included with the invention defined by the claims.

It is claimed:

1. A golf club comprising:

(a) a striking head having a front surface and a back surface, the front surface being the striking surface, the striking head also having a hosel;

(b) a shaft having a first end and a second end, wherein the first end of the shaft is in connection with the hosel of the striking head;

(c) a grip into which the second end of the shaft is inserted;

(d) at least one constrained layer damper attached to the shaft, wherein each constrained layer damper is non-tubular and each constrained layer damper independently comprises:

(i) a non-tubular outer rigid layer, (ii) a non-tubular outer vibration damping material layer comprising a viscoelastic material attached to one side of the outer rigid layer;

wherein each non-tubular outer rigid layer has a shear modulus at least about 10 times greater than that of the vibration damping material layer(s); and wherein the constrained layer damper(s) are attached to the shaft in such a manner that the outer vibration damping material layer is adjacent to the shaft;

wherein at least one damper must be positioned on the shaft such that it at least partially falls within one or both of the following degree ranges; (i) the 1 to 179 degree range; (ii) the 181 to 359 degree range;

wherein the degree ranges are calculated such that when the club is positioned striking surface down on a flat surface the 90 degree point is the uppermost point on the shaft when viewed in cross section from the direction of the striking head toward the gripping end and the 270 degree point is the lowermost point on the shaft when the shaft is likewise viewed in cross section.

2. The golf club of claim 1 wherein at least one damper must be positioned on the shaft such that (1) at least a 30 degree range total is covered by vibration damping material layer(s) of the damper(s) in the 60 to 120 degree range, or (2) at least a 30 degree range total is covered in the 240 to 300 degree range, or (3) at least a 30 degree range total is covered within the 60 to 120 degree range plus the 240 to 300 degree range.

3. The golf club of claim 1 wherein at least one damper must be positioned on the shaft such that (1) at least a 60 degree range total is covered by vibration damping material layer(s) of the damper(s) in the 60 to 120 degree range, or (2) at least a 60 degree range total is covered in the 240 to 300 degree range, or (3) at least a 60 degree range total is covered within the 60 to 120 degree range plus the 240 to 300 degree range.

4. The golf club of claim 1 wherein each damper is independently positioned along or parallel to a shortest line segment connecting a point on the first end of the shaft to a point on the second end of the shaft at the same degree point on circumference of the shaft.

5. The golf club of claim 1 wherein the constrained layer damper(s) are positioned such that at least a portion of the damper falls within an area which is greater than 20 percent the length of the shaft away from the first end of the shaft and greater than 40 percent the length of the shaft from the second end of the shaft.

6. The golf club of claim 1 wherein the constrained layer damper(s) are positioned such that all the damper(s) fall entirely within an area which is greater than 20 percent the length of the shaft away from the first end of the shaft and greater than 40 percent the length of the shaft from the second end of the shaft.

7. The golf club of claim 1 wherein the constrained layer damper(s) are positioned such that at least a portion of the damper falls within an area which is greater than 25 percent the length of the shaft away from the first end of the shaft and greater than 45 percent the length of the shaft from the second end of the shaft.

8. The golf club of claim 1 wherein the constrained layer damper(s) are positioned such that all the damper(s) fall entirely within an area which is greater than 25 percent the length of the shaft away from the first end of the shaft and greater than 45 percent the length of the shaft from the second end of the shaft.

9. The golf club of claim 1 wherein the constrained layer damper(s) are positioned such that at least a portion of the damper falls within an area which is greater than 30 percent the length of the shaft away from the first end of the shaft and greater than 50 percent the length of the shaft from the second end of the shaft.

10. The golf club of claim 1 wherein the constrained layer damper(s) are positioned such that all the damper(s) fall entirely within an area which is greater than 30 percent the length of the shaft away from the first end of the shaft and greater than 50 percent the length of the shaft from the second end of the shaft.

11. The golf club of claim 1 wherein the length of each constrained layer damper is about 10 to about 100 percent of the length of the shaft.

12. The golf club of claim 1 having about 1 to about 40 constrained layer dampers.

13. The golf club of claim 1 having about 2 to about 20 constrained layer dampers.

14. The golf club of claim 1 having about 2 to about 8 constrained layer dampers.

15. The golf club of claim 1 wherein the constrained layer damper(s) are attached to an internal surface of the shaft.

16. The golf club of claim 1 wherein the constrained layer damper(s) are attached to an external surface of the shaft.

17. The golf club of claim 16 wherein the constrained layer damper(s) are attached to indentations(s) in the external surface of the shaft.

18. The golf club of claim 16 wherein four constrained layer dampers are attached to the shaft such that a longitudinal center line of a first damper is at 0°, a longitudinal center line of a second damper is at 90°, a longitudinal center line of a third damper is at 180° and a longitudinal center line of a fourth damper is at 270°.

19. The golf club of claim 16 wherein the constrained layer damper(s) are positioned such that the golf club would meet the requirements of the United States Golf Association.

20. The golf club of claim 16 wherein the same degree ranges are covered by two or more separate dampers.

* * * * *